US010072453B2

(12) United States Patent
Ihlenburg et al.

(10) Patent No.: US 10,072,453 B2
(45) Date of Patent: Sep. 11, 2018

(54) VEHICLE DOOR CONTROL SYSTEM

(71) Applicant: MAGNA ELECTRONICS INC., Holly, MI (US)

(72) Inventors: Joern Ihlenburg, Berlin (DE); Michael Schaffner, Gross-Gerau (DE)

(73) Assignee: MAGNA ELECTRONICS INC., Auburn Hills, MI (US)

( * ) Notice: Subject to any disclaimer, the term of this patent is extended or adjusted under 35 U.S.C. 154(b) by 0 days.

(21) Appl. No.: 15/295,059

(22) Filed: Oct. 17, 2016

(65) Prior Publication Data

US 2017/0030136 A1 Feb. 2, 2017

Related U.S. Application Data

(63) Continuation of application No. 14/753,924, filed on Jun. 29, 2015, now Pat. No. 9,470,034, which is a (Continued)

(51) Int. Cl.
*E05F 15/73* (2015.01)
*E05F 15/40* (2015.01)
(Continued)

(52) U.S. Cl.
CPC ..... *E05F 15/73* (2015.01); *E05F 15/40* (2015.01); *E05F 15/74* (2015.01); *E05F 15/00* (2013.01);
(Continued)

(58) Field of Classification Search
CPC . E05F 15/00; E05F 15/40; E05F 15/73; E05F 15/74; E05F 2015/434; E05F 2015/767; E05Y 2900/546
(Continued)

(56) References Cited

U.S. PATENT DOCUMENTS 5,550,677 A 8/1996 Schofield et al.
5,670,935 A 9/1997 Schofield et al.
(Continued)

FOREIGN PATENT DOCUMENTS

DE 102011010242 8/2011
DE 102010009889 9/2011
(Continued)

OTHER PUBLICATIONS

Brose Technik fur Automobile Press Release, IAA 2011.

*Primary Examiner* — Tyler J Lee
(74) *Attorney, Agent, or Firm* — Honigman Miller Schwartz and Cohn, LLP

(57) ABSTRACT

A vehicle door control system includes a camera disposed at a portion of the vehicle and having a field of view that encompasses a region exterior of the vehicle that is swept by a door of the vehicle as the door is opened and closed via a powered door opening/closing system of the vehicle. An image processor is operable to process image data captured by the camera to detect an object present in the region that is swept by the door when the door is opening and to determine if the door may collide with the detected object when the door is being opened. During opening of the door and responsive to determination of a potential collision of the opening door with the detected object, the vehicle door control system positions the door at a partially open position whereby a gap is established between the door and the detected object.

21 Claims, 18 Drawing Sheets

Related U.S. Application Data continuation of application No. 14/159,772, filed on Jan. 21, 2014, now Pat. No. 9,068,390.

(60) Provisional application No. 61/754,804, filed on Jan. 21, 2013.

(51) Int. Cl.
*E05F 15/74* (2015.01)
*E05F 15/43* (2015.01)
*E05F 15/00* (2015.01)

(52) U.S. Cl.
CPC ... *E05F 2015/434* (2015.01); *E05F 2015/767* (2015.01); *E05Y 2900/546* (2013.01)

(58) Field of Classification Search
USPC ..... 701/49
See application file for complete search history.

(56) References Cited

U.S. PATENT DOCUMENTS

| | | | |
|---|---|---|---|
| 5,949,331 | A | 9/1999 | Schofield et al. |
| 6,836,209 | B2 | 12/2004 | Ploucha |
| 7,026,930 | B2 | 4/2006 | Appel et al. |
| 7,280,035 | B2 | 10/2007 | McLain et al. |
| 7,528,703 | B2 | 5/2009 | Touge |
| 7,547,058 | B2 | 6/2009 | King et al. |
| 8,638,205 | B2 | 1/2014 | Boehme et al. |
| 8,830,317 | B2 | 9/2014 | Meier |
| 9,068,390 | B2 | 6/2015 | Ihlenburg et al. |
| 9,470,034 | B2 | 10/2016 | Ihlenburg et al. |
| 2002/0084675 | A1 | 7/2002 | Buchanan et al. |
| 2007/0236364 | A1 | 10/2007 | Hubbard |
| 2007/0273554 | A1 | 11/2007 | Sakakibara |
| 2007/0296242 | A1 | 12/2007 | Frommer et al. |
| 2008/0294314 | A1 | 11/2008 | Morris et al. |
| 2009/0000196 | A1 | 1/2009 | Kollar et al. |
| 2011/0043633 | A1 | 2/2011 | Sarioglu et al. |
| 2011/0196568 | A1 | 8/2011 | Nickolauo et al. |
| 2013/0055639 | A1* | 3/2013 | Brosseit ..... B60J 5/101 49/31 |
| 2013/0235204 | A1 | 9/2013 | Buschmann |
| 2014/0168415 | A1 | 6/2014 | Ihlenburg et al. |
| 2014/0168437 | A1 | 6/2014 | Rother |
| 2014/0218529 | A1 | 8/2014 | Mahmoud et al. |

FOREIGN PATENT DOCUMENTS

| | | |
|---|---|---|
| WO | WO2013081984 | 6/2013 |
| WO | WO2013081985 | 6/2013 |
| WO | WO2013/109869 | 7/2013 |

* cited by examiner

VEHICLE DOOR CONTROL SYSTEM

CROSS REFERENCE TO RELATED APPLICATION

The present application is a continuation of U.S. patent application Ser. No. 14/753,924, filed Jun. 29, 2015, now U.S. Pat. No. 9,470,034, which is a continuation of U.S. patent application Ser. No. 14/159,772, filed Jan. 21, 2014, now U.S. Pat. No. 9,068,390, which claims the filing benefits of U.S. provisional application Ser. No. 61/754,804, filed Jan. 21, 2013, which is hereby incorporated herein by reference in its entirety.

FIELD OF THE INVENTION

The present invention relates to imaging systems or vision systems for vehicles.

BACKGROUND OF THE INVENTION

Use of imaging sensors in vehicle imaging systems is common and known. Examples of such known systems are described in U.S. Pat. Nos. 5,949,331; 5,670,935 and/or 5,550,677, which are hereby incorporated herein by reference in their entireties.

SUMMARY OF THE INVENTION

The present invention provides a vision system or imaging system for a vehicle that utilizes one or more cameras to capture images exterior of the vehicle, and provides the communication/data signals, including camera data or image data that may be displayed or processed to provide the desired display images and/or processing and control, depending on the particular application of the camera and vision or imaging system. The present invention utilizes such a vehicle camera or sensor to provide a vehicle hatch control system or collision avoidance system using rear camera image processing to detect objects in the sweeping or turning area or path of a vehicle hatch (such as a vehicle hatch that is being opened or closed, such as via a powered opening/closing system of the vehicle) and, responsive to detection of such an object, the system may stop or reverse the hatch to limit or avoid collision of the hatch with the object present in its path.

According to an aspect of the present invention, a vehicle hatch collision avoidance or control system includes a camera or image sensor disposed at a rear portion of a vehicle and having a rearward field of view that encompasses the region to the rear of the vehicle and the region that is swept by a hatch, liftgate, door or trunk lid or deck lid of the vehicle as it is opened and closed, such as via a powered hatch opening/closing system of the vehicle. The system includes an image processor that processes image data captured by the rear camera to determine if an object or structure is present in the region that is swept by the hatch or liftgate to determine if the hatch may collide with the detected object when the hatch is being opened and/or closed. Responsive to determination of a potential collision of the hatch with a detected object, the system may stop or reverse the movement of the hatch or otherwise position the hatch at a partially open position that provides a gap between the hatch and the detected object. The vehicle hatch control system is operable to generally maintain the gap between the hatch and the detected object when the vehicle's body height changes, such as during loading and/or unloading of the vehicle.

The vehicle hatch control system may process captured image data to detect objects in the path of travel of the vehicle hatch or liftgate in response to actuation of the powered hatch opening/closing system. Optionally, responsive to actuation of the powered hatch or liftgate opening/closing system, the vehicle hatch control system may actuate an illumination source at the rear of the vehicle to illuminate the region at the rear of the vehicle to enhance visibility and/or detection of objects present at the rear of the vehicle. Such activation of an illumination source (such as a rear backup light of the vehicle or a brake light of the vehicle or a license plate light of the vehicle or the like) may also be responsive to a determination of an ambient lighting condition being below a threshold level. Optionally, the system may generate an audible or visual alert to alert the user that a collision or impact is imminent.

According to another aspect of the present invention, a vehicle hatch control system includes or is responsive to a camera disposed at a rear portion of a vehicle and having a field of view that encompasses a rear storage region of the vehicle that is enclosed by a hatch of the vehicle when the hatch is closed. An image processor may be operable to process image data captured by the camera to determine if an object is present in the rear storage region and to determine if the detected object would contact the hatch as the hatch is moved from an opened position to a fully closed position. Responsive to at least one of (i) determination of a detected object in the rear storage region and a potential contact of the hatch with the detected object and (ii) a user input, the vehicle hatch control system is operable to position the hatch at a partially closed position with a gap established between the hatch and the detected object. The vehicle hatch control system is operable to control the hatch to generally maintain the gap between the hatch and the detected object when the equipped vehicle is being driven.

These and other objects, advantages, purposes and features of the present invention will become apparent upon review of the following specification in conjunction with the drawings.

BRIEF DESCRIPTION OF THE DRAWINGS

FIG. 4 is a flow chart of operation of a hatch opening control system of the present invention, showing processing of an 'Open Request' in accordance with the present invention, where the 'Safety distance' may be given as a parameter and where the 'Desired opening position' value may be set by the user when initiating the 'Open request', such as by a user input or gesture or the like;

LEGEND TO THE DRAWINGS

Figure 1:
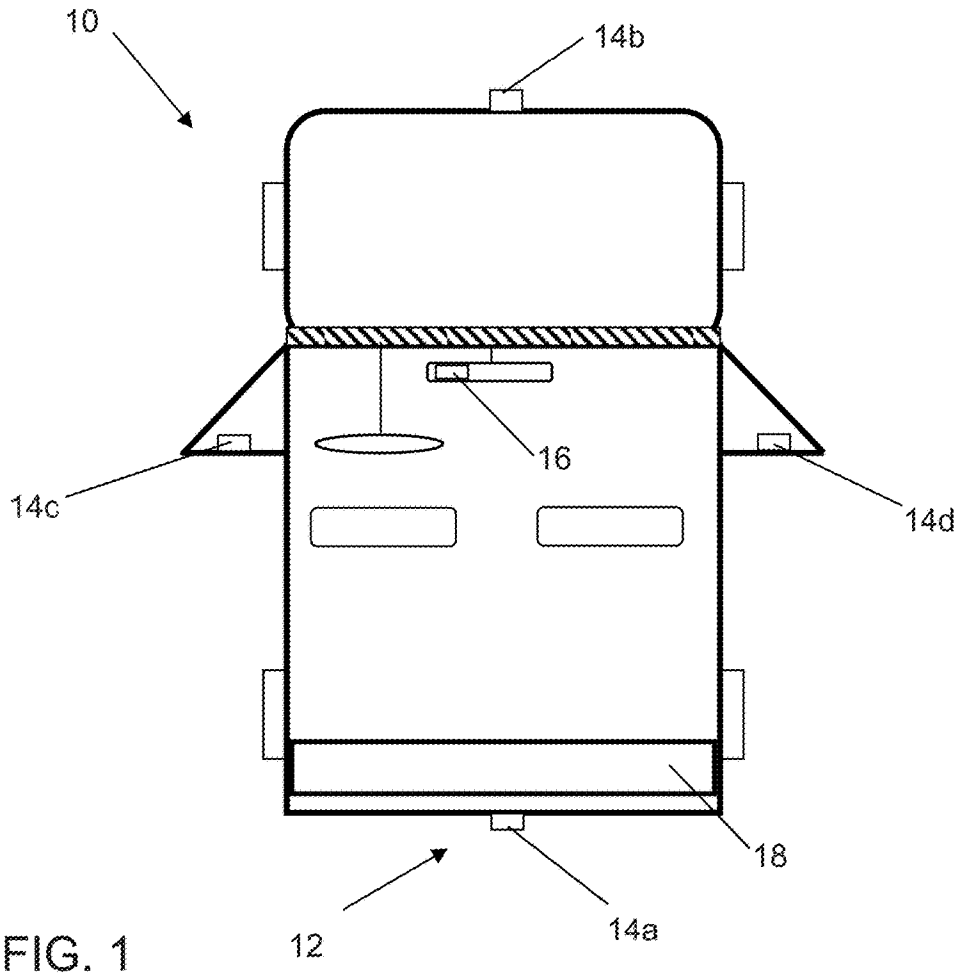
FIG. 1 is a plan view of a vehicle with a vision system and imaging sensors or cameras that provide exterior fields of view in accordance with the present invention.

10 vehicle
12 vision system
14*a* rear camera
14*b* forwardly facing camera
14*c*, 14*d* cameras at the sides of the vehicle
18 hatch
30 hatch hinge
32 hatch actuator
33 (third) center brake light
40 object

DESCRIPTION OF THE PREFERRED EMBODIMENTS

A driver assist system and/or vision system and/or object detection system and/or alert system may operate to capture images exterior of the vehicle and process the captured image data to detect objects at or near the vehicle and in the predicted path of the vehicle, such as to assist a driver of the vehicle in maneuvering the vehicle in a rearward direction. The object detection may utilize detection and analysis of moving vectors representative of objects detected in the field of view of the vehicle camera, in order to determine which detected objects are objects of interest to the driver of the vehicle, such as when the driver of the vehicle undertakes a reversing maneuver or opens the tailgate or rear door of the vehicle.

Referring now to the drawings and the illustrative embodiments depicted therein, a vehicle 10 includes an imaging system or vision system 12 that includes one or more imaging sensors or cameras (such as a rearward facing imaging sensor or camera 14*a* and/or a forwardly facing camera 14*b* at the front (or at the windshield) of the vehicle, and/or a sidewardly/rearwardly facing camera 14*c*, 14*b* at the sides of the vehicle), which capture images exterior of the vehicle, with the cameras having a lens for focusing images at or onto an imaging array or imaging plane of the camera (FIG. 1). The vision system 12 is operable to process image data captured by the cameras and may provide displayed images at a display device 16 for viewing by the driver of the vehicle. Optionally, the vision system may process image data to detect objects, such as objects to the rear of the subject or equipped vehicle during a reversing maneuver, or such as approaching or following vehicles or vehicles at a side lane adjacent to the subject or equipped vehicle or the like.

The present invention provides a hatch control system or hatch collision avoidance system for a vehicle that is operable to stop the opening or closing of a hatch or trunk lid or lift gate or deck lid or rear door of a vehicle when it is determined that an object is in the path of travel of the hatch and will be contacted or impacted by the hatch if the hatch continues towards its fully opened or fully closed position. For example, the system, responsive to a determination that an object is outside of the vehicle and above or rearward of the hatch and in the path of travel of the hatch when opening (and with the system being activated to monitor the path of travel responsive to an opening of the hatch or activation of a powered hatch opening/closing device or the like), is operable to stop movement or opening of the hatch at a predetermined or selected or appropriate distance from the object such that a gap is provided between the stopped partially opened hatch and the detected object. Likewise, the system, responsive to a determination that an object is inside a rear storage area or region of the vehicle and below or forward of the hatch and in the path of travel of the hatch when closing (and with the system being activated to monitor the path of travel responsive to a closing of the hatch or activation of a powered hatch opening/closing device or the like), is operable to stop movement or closing of the hatch at a predetermined or selected or appropriate distance from the object such that a gap is provided between the stopped partially closed hatch and the detected object. The system may utilize aspects of the systems described in U.S. Publication No. US 2011-0043633, published Feb. 24, 2011, which is hereby incorporated herein by reference in its entirety.

The system may adjust the position of the hatch to maintain the gap. For example, the system may, when the hatch is partially opened and near an object above the hatch, and when the vehicle is unloaded so that the vehicle body raises upward, be operable to adjust or move the hatch to further close the hatch so that the initial gap is generally maintained between the partially opened hatch and the detected object. Also, for example, the system may, when the hatch is partially closed and near an object in the storage area of the vehicle, be operable to maintain the gap (such as via movement adjustment of the hatch or actuation of the powered hatch opening/closing device) while the vehicle is being driven and thus while forces (such as inertia forces) act on the hatch to make the hatch move up or down, so that the hatch does not contact or compress the object and does not open to allow the object to fall out of the hatch. Thus, the present invention provides dynamic control of a powered hatch of a vehicle to maintain a desired or selected or appropriate gap between the hatch and an object in the path of the hatch when opening or between the hatch and an object in the storage area of the vehicle and in the path of travel of the hatch when closing. The system may include or may be responsive to a camera or image sensor or other sensor at or of the vehicle (such as a camera that is part of a vehicle vision system or surround view vision system or the like) that has a field of view that encompasses the region exterior of the vehicle that is swept by the hatch when opening/closing, and/or may include or may be responsive to a camera or image sensor or other sensor at or of the vehicle that has a field of view that encompasses the rear storage area or region of the vehicle.

Figure 2A:
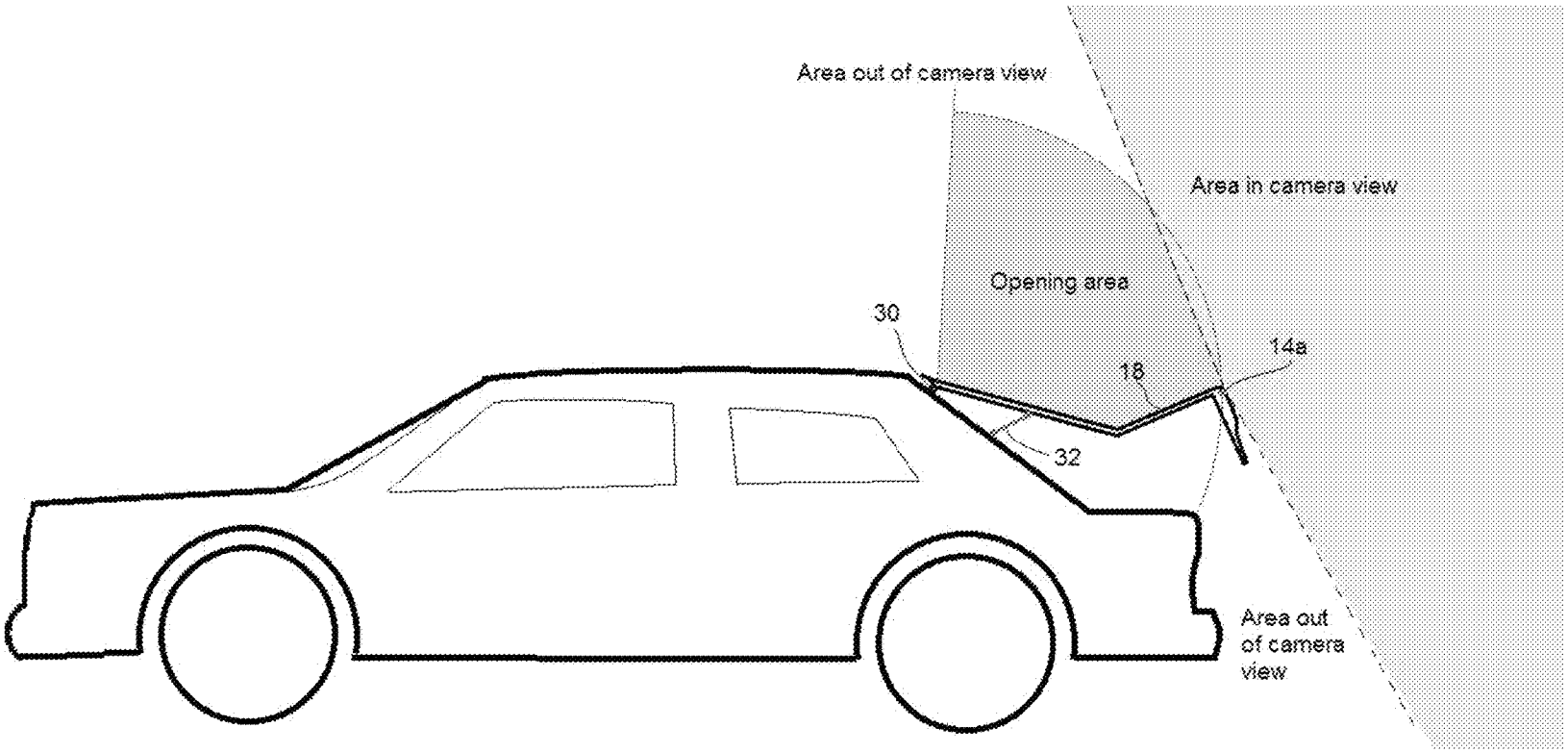
FIG. 2A is a side view of a vehicle with a rear camera of a hatch control system mounted at the emblem position of the hatch and providing an exterior field of view in accordance with the present invention.

As shown in FIG. 2A, the hatch of a vehicle has a limited opening range, sweeping through the space of the 'Opening area'. The hatch is shown in a partially open position, and there is an Area currently in the camera's view. The area beyond the opening angle of the camera lens is out of camera's view (at least currently). The part of the opening area close to the hinge 30 is never in the camera view due to the mounting position of the camera. The area (exposed) at the far end of the hatch is always covered by the 'Area in camera view'.

Figure 2B:
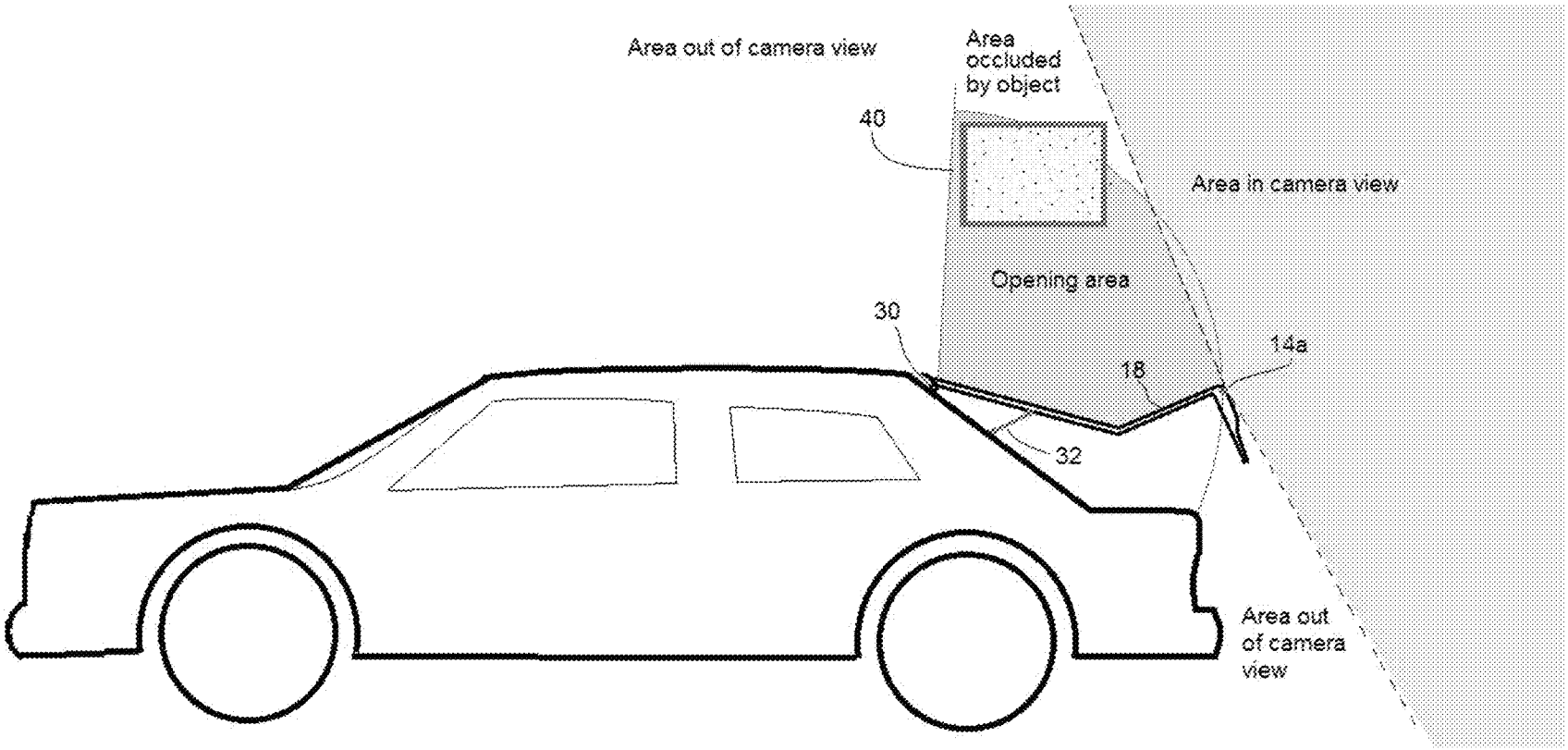
FIG. 2B is a side view of the vehicle showing a scene similar to that in FIG. 2A, with the hatch shown at about one third open of the maximal opening, and with an object in the path of travel or opening area of the deck lid or hatch of the vehicle.
Figure 2C:
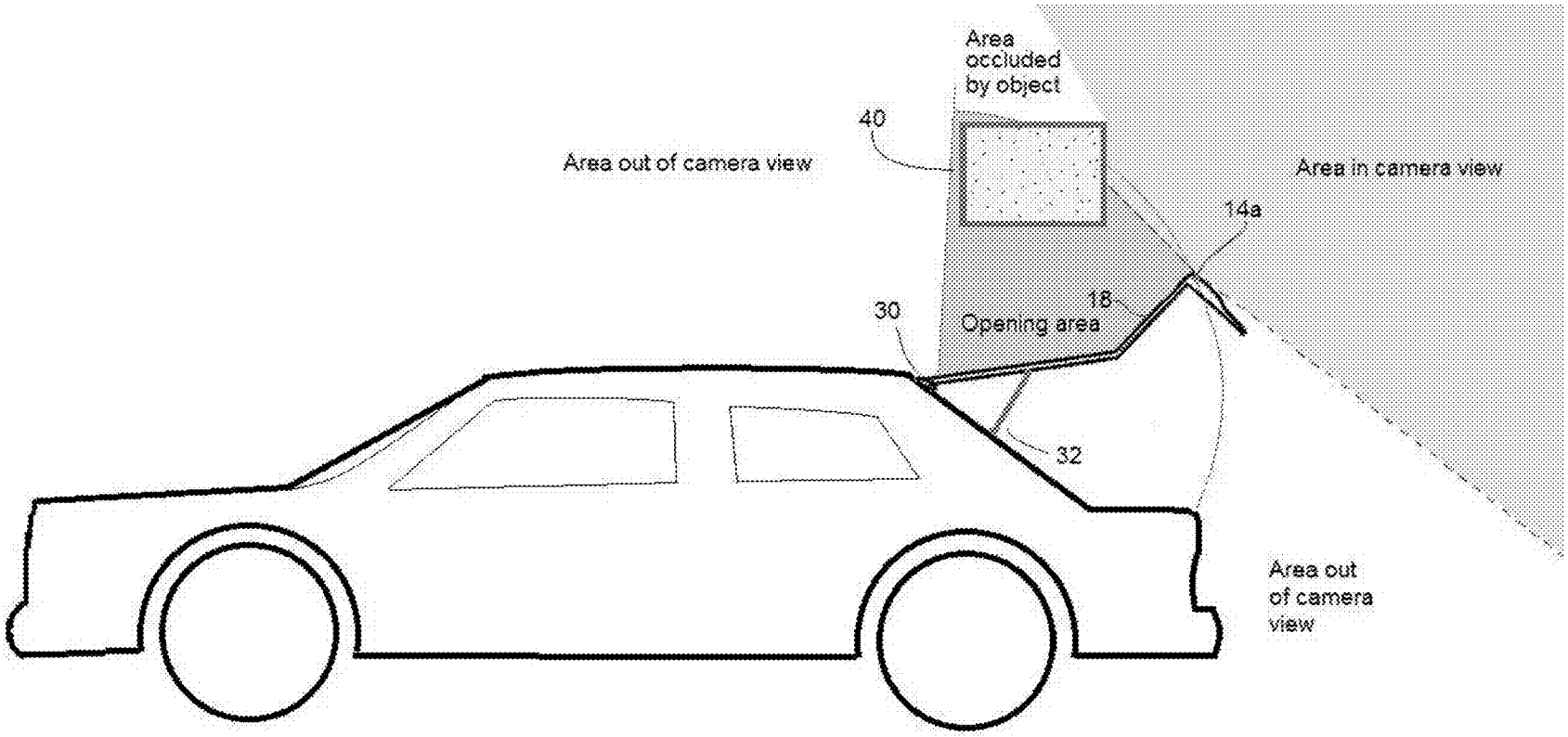
FIG. 2C is a side view of the vehicle showing the same scene as shown in FIG. 2B, but with the hatch about half open and closer to the object.

As shown in FIG. 2B, the 'Area in camera view' (when the camera is mounted at or in the hatch emblem position as shown) does not cover the structural object above the vehicle's hatch. As shown in FIG. 2C, the structural object above the vehicle's hatch is partially in the camera's view (when the camera is mounted at in the hatch emblem position such as shown). An object hazard detection and anti-collision system according to the present invention may be able to detect the object in the sweeping area and may stop the hatch opening early enough before the hatch collides with the detected object.

Figure 3A:
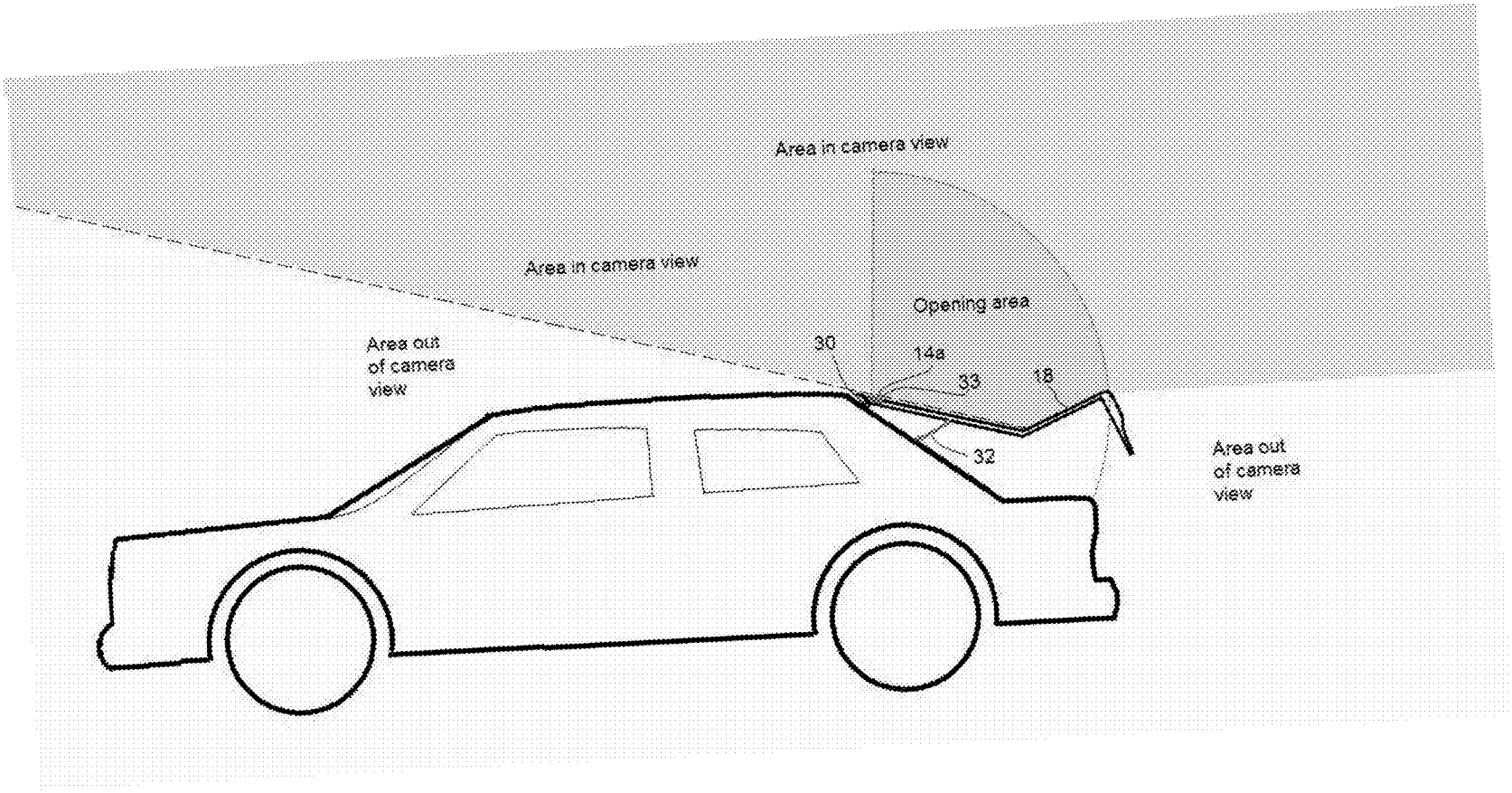
FIG. 3A is a side view of another vehicle with a rear camera of a hatch control system integrated to the (third) center brake light in accordance with the present invention, shown with the hatch having a limited opening range and sweeping through the space of the "Opening area"
Figure 3B:
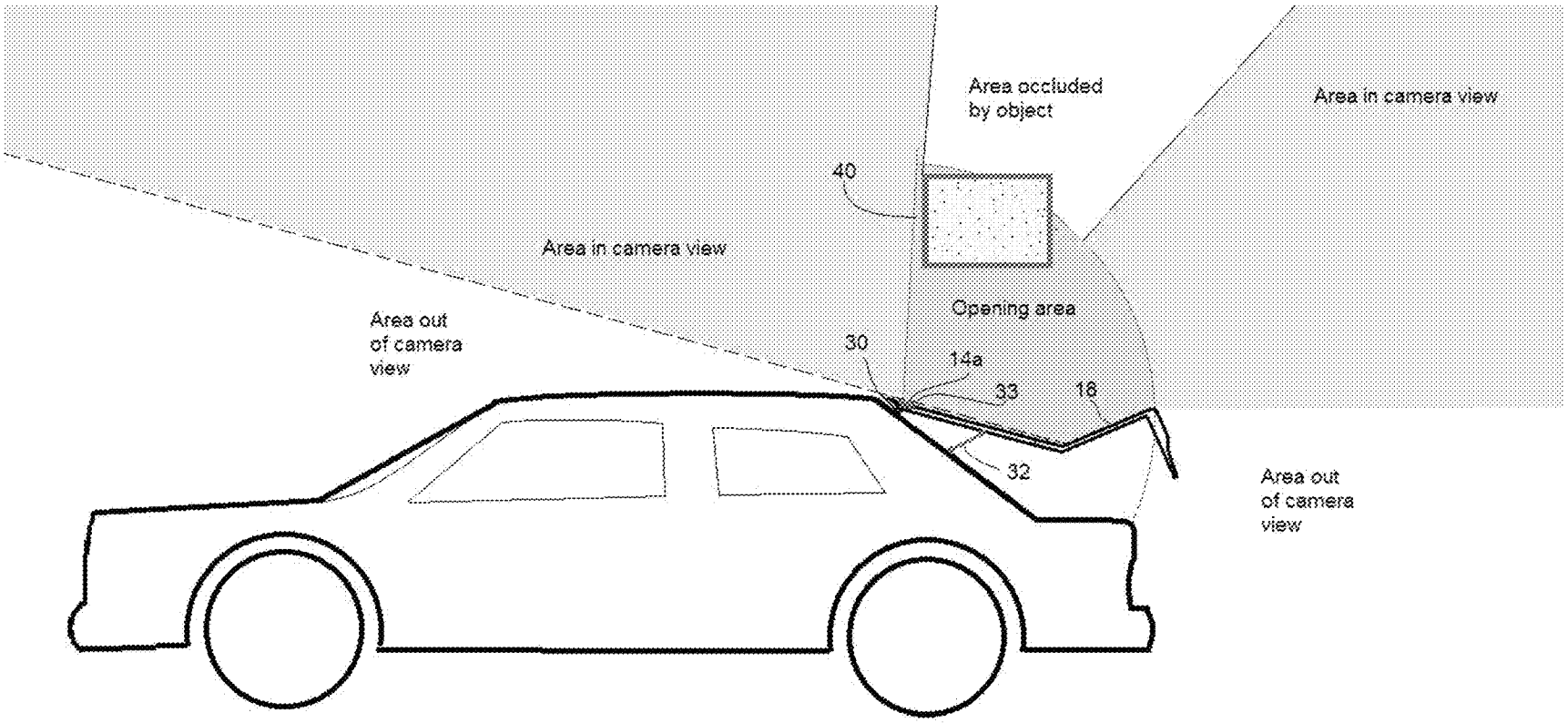
FIG. 3B is a side view of the vehicle showing a scene similar to that in FIG. 3A, shown with the hatch at about one third open of the maximal opening, and with an object in the path of travel or opening area of the deck lid or hatch of the vehicle.
Figure 3C:
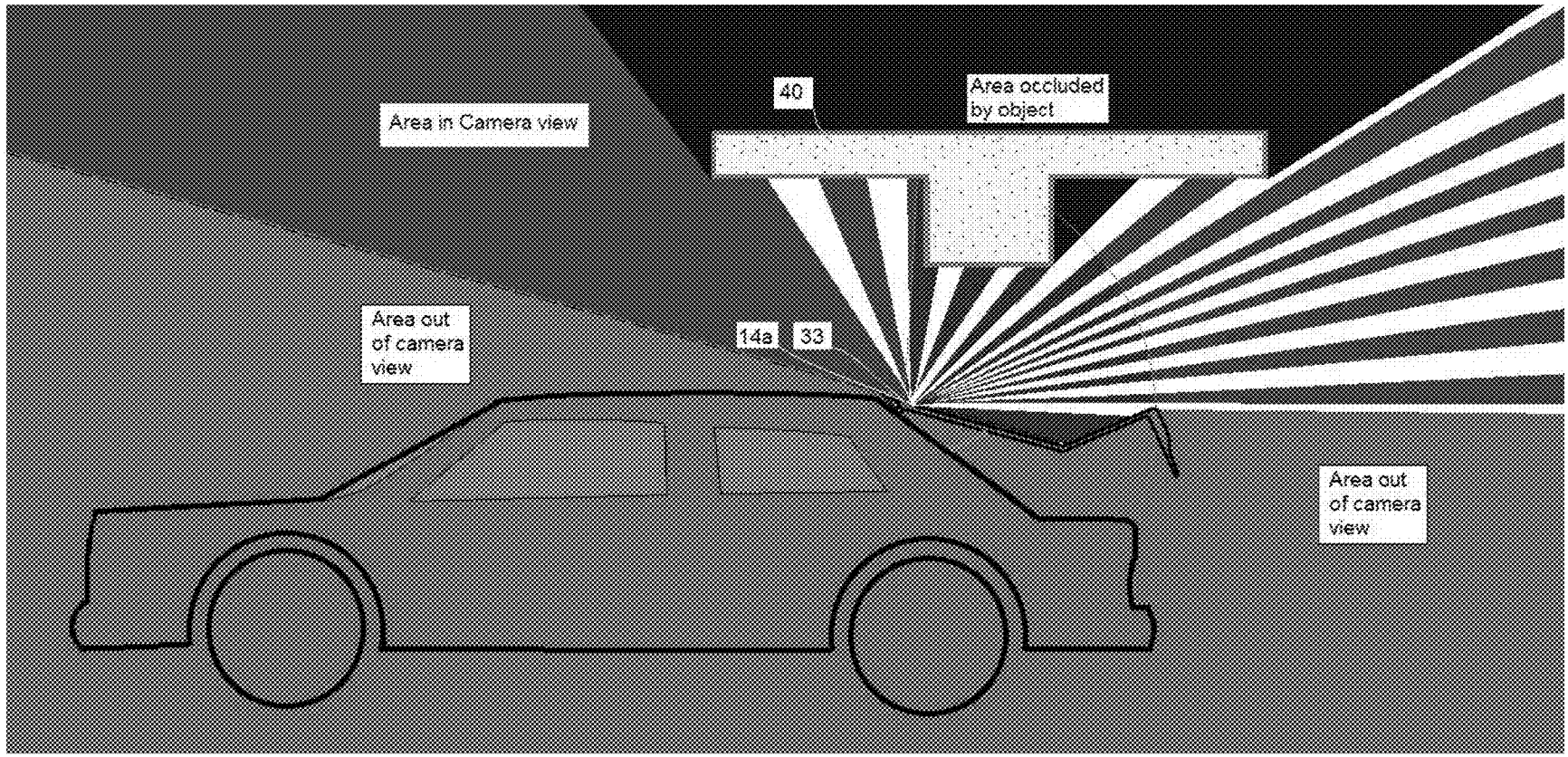
FIG. 3C is a side view of the vehicle showing a scene similar to that in FIG. 3B, but shown at night.

As shown in FIG. 3A, the vehicle may have a rear camera integrated to the (third) center brake light. The hatch has a limited opening range, sweeping through the space of the 'Opening area'. The hatch is shown in FIG. 3A in a partially open position, and the Area in the view of the camera always covers the opening area. When the hatch is about one third open of the maximal opening (such as shown in FIG. 3B), the 'Area in camera view' (when the camera is mounted at the (third) center brake light position) does cover the structural object above the vehicle's hatch. An object hazard detection and anti-collision system according to the present invention may be able to detect the object in the sweeping area and may stop the hatch opening at a selected or parameterized distance, but at least early enough before the hatch collides with it. Optionally, and such as shown in FIG. 3C, the center brake light may have a cover glass staying, reflecting, bending or focusing its light so that it emits a pattern to its scene in front. The pattern may be picked up by the camera and processed by the image processing and object detection system interpreting it as structured light (the structural pattern (reflections) in the near may show smaller patterns as such in further distance).

The system of the present invention is operable to detect objects 40 present rearward and or upward of the vehicle (FIGS. 12, 13 and 14) and in a path of travel or in a region that is swept by a hatch or liftgate 18 of the vehicle, which may be actuated by actuators 32 and which may pivot or swing about a generally horizontal pivot axis at an upper region of the vehicle between its opened and closed positions, such as in response to actuation by a user of a powered hatch opening/closing system of the vehicle. Optionally, the system of the present invention may be operable to detect objects 40 present rearward of the vehicle and in a path of travel (shown in dark gray in FIGS. 2A, 2B, 2C, 3A, 3B and 11) or in a region that is swept by one or more hatches or rear doors 18 of the vehicle (such as a pair of two mating doors as to be seen at BMW Clubman or Mercedes-Benz Sprinter (NCV3), but without having propelled or automatic doors), which may pivot or swing about a generally lateral pivot axis at a sideward region of the vehicle between their opened and closed positions. The rear camera 14*a* may be disposed at the rear portion of the vehicle and have its field of view encompassing the area immediately rearward of the vehicle and optionally above the vehicle so as to encompass most or all of the region that may be swept by the hatch or liftgate as it pivots between its opened and closed positions.

Figure 11:
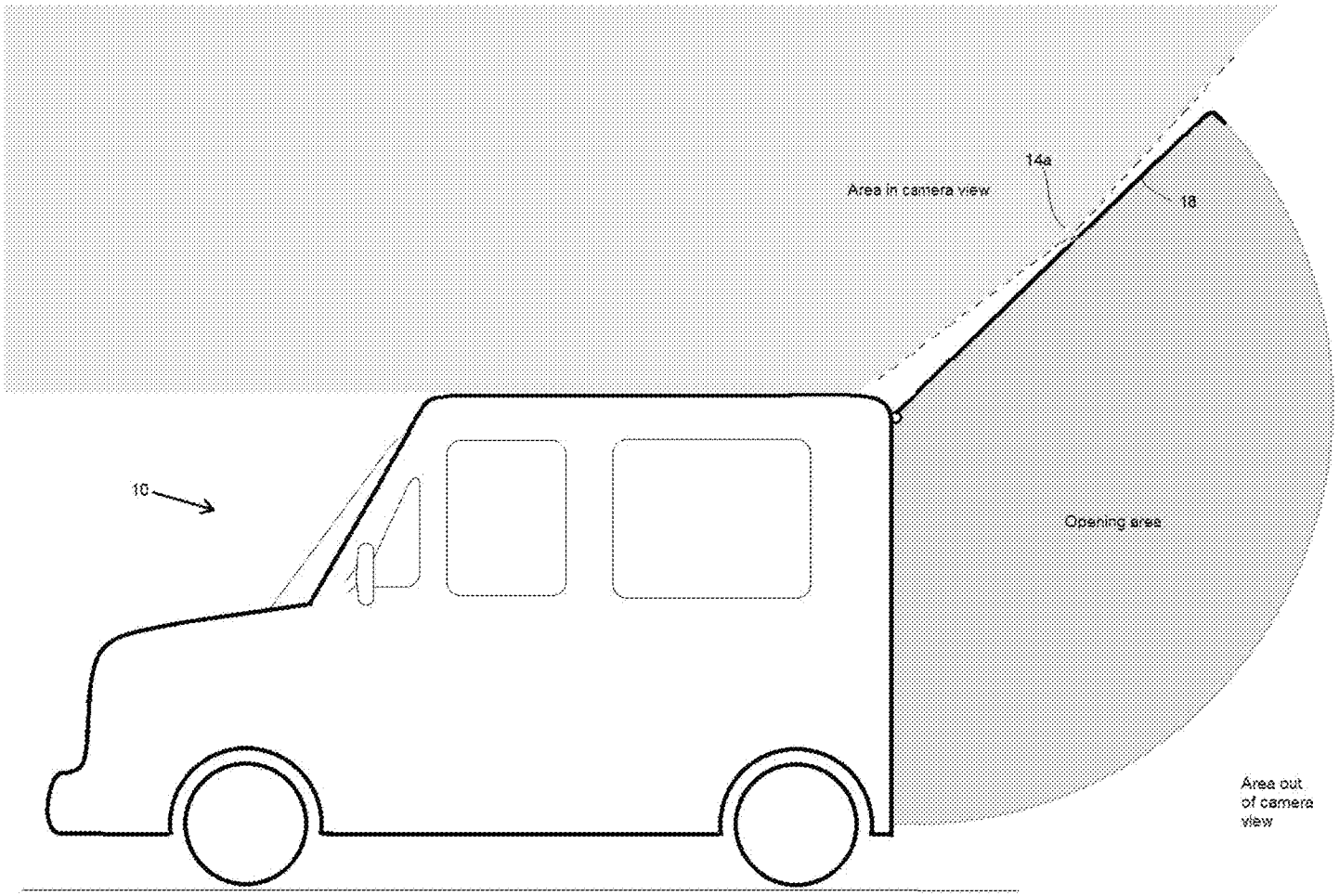
FIG. 11 is a side view of a minivan type of vehicle, with the power hatch having a limited opening range and sweeping through the space of the 'Opening area', whereby the hatch is shown in a maximal open position, with an Area currently in the camera view covering the sweeping area well (the hatch actuator is not shown)
Figure 12:
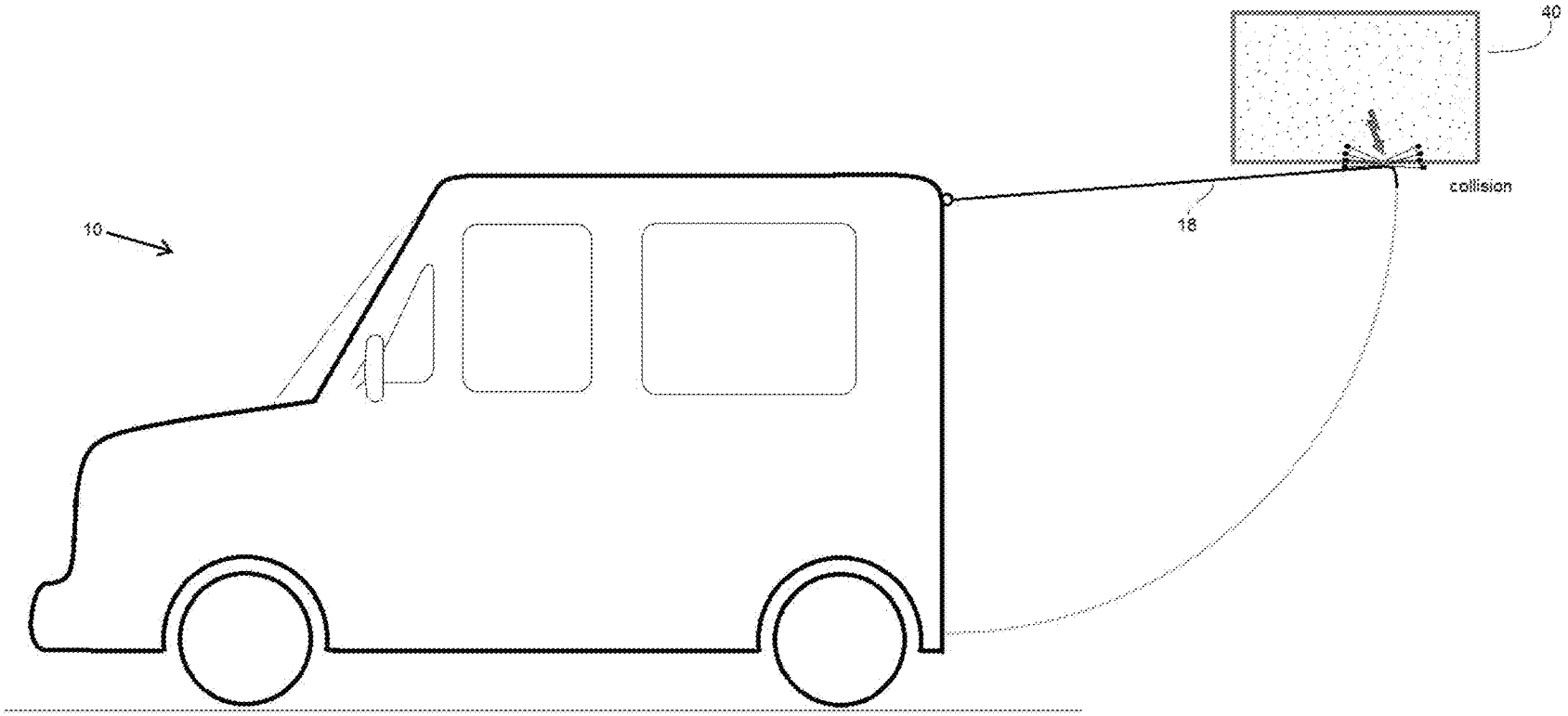
FIG. 12 is a side view of a minivan type of vehicle, similar to FIG. 11, with the vehicle shown not having a rear camera or anti hatch collision or object hazard detection system, shown with the power hatch colliding at it's far end with a structural object above the rear of the vehicle (such as a part of a parking garage or the like)
Figure 13:
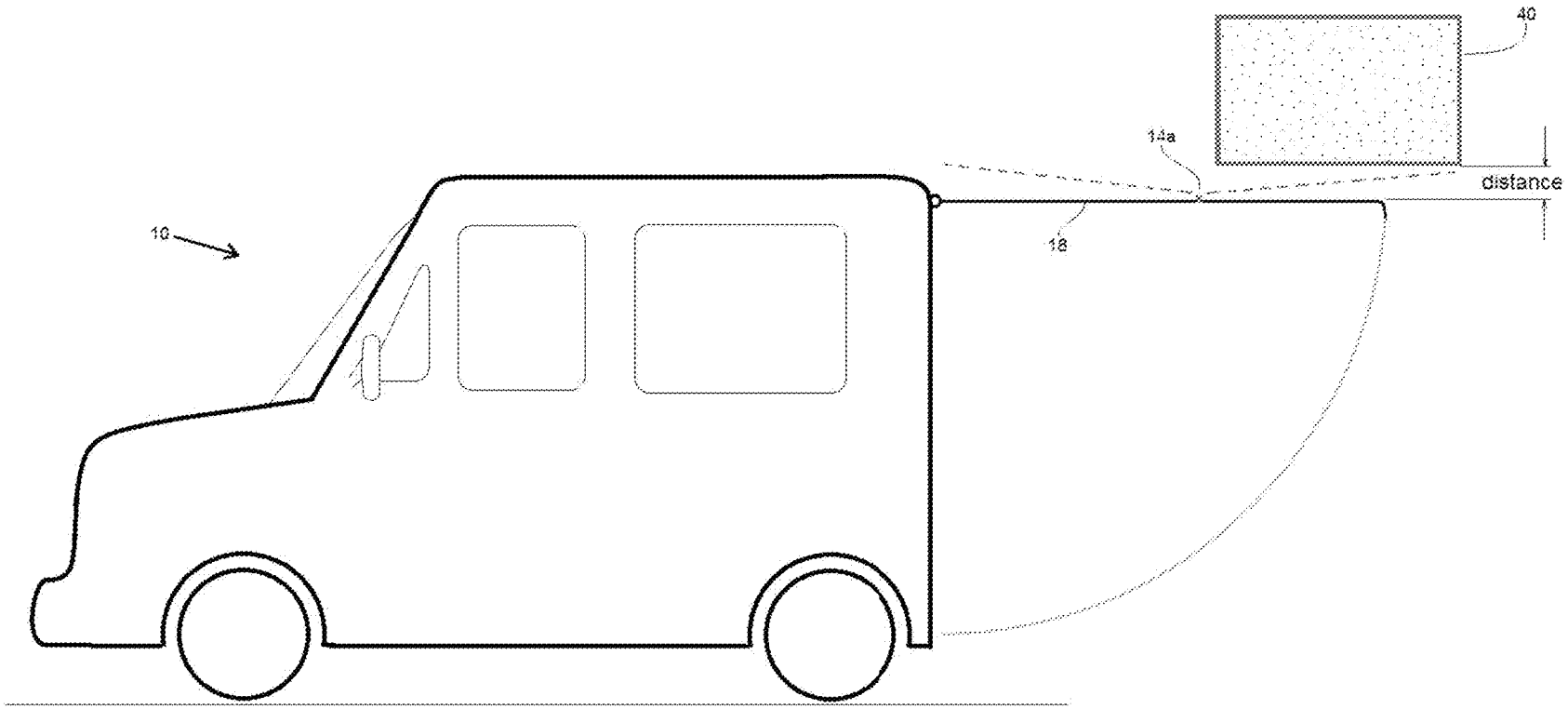
FIG. 13 is a side view of a minivan type of vehicle which includes a rear camera and object hazard detection and anti-collision system of the present invention, such as with an anti-collision algorithm such as shown in FIG. 4, and shown with a structural object above the rear of the vehicle (such as part of a parking garage or the like) that is being picked up by the camera at the hatch and acknowledged as hazardous in the sweeping area of the hatch by the object hazard detection system of the present invention, whereby the system may stop the hatch at a selected or parameterized distance from the detected object in accordance with the present invention.
Figure 14:
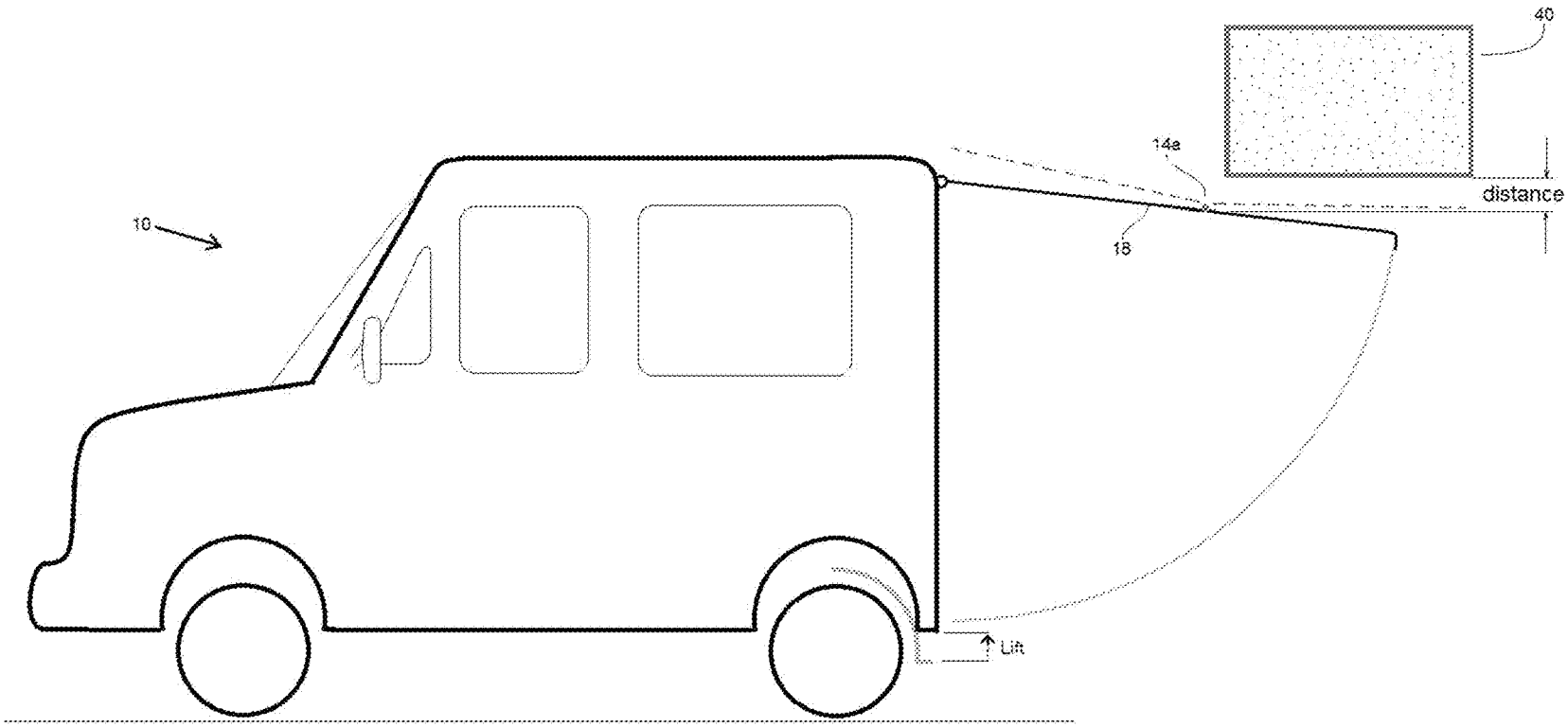
FIG. 14 is a side view of a minivan type vehicle which has a rear camera and object hazard detection and anti-collision system of the present invention and employing an anti-collision algorithm such as shown in FIG. 4, shown as a scene that may be consecutive to FIG. 13, whereby, due to unloading of the vehicle and by that lightening the vehicle, the vehicle suspension may lift or raise the vehicle body by the way of travel shown by an arrow with marked with 'Lift', and whereby the anti-collision algorithm such as shown in FIG. 4 may control the hatch actuator to lower the hatch (in the closing direction) to keep or maintain or reacquire a selected or determined or parameterized distance or gap between the hatch and the detected object at the upper rear of the vehicle in accordance with the present invention.

In an application where the camera is disposed at the rear portion of the vehicle, the camera may be mounted stationary at the vehicle body or may be mounted at the liftgate, hatch, door or lid 18, whereby the camera moves or turns with the door when it opens or closes, such as shown in FIGS. 11,13 and 14.

Optionally, the camera 14*a* may be mounted in the region of the license plate illumination, the in the region of the rear emblem (there it may be integrated to the design or it may be behind the emblem which may flap away when the camera is active) such as shown in the example in FIGS. 2A, 2B and 2C, may be mounted in the dry room or space behind the rear hatch window preferably in the region covered by the rear window wiper, or integrated into the third/top brake light (in the middle) 33 such as shown in example of FIG. 3 or in the area of the rear window washer nozzle. Due to the camera being optionally mounted on a movable flap (lid, hatch, door or gate), the field of view or view area of the camera may change during sweeping or opening/closing of the door. Hence, objects may come into the view area of the camera during the sweep.

Figure 4:
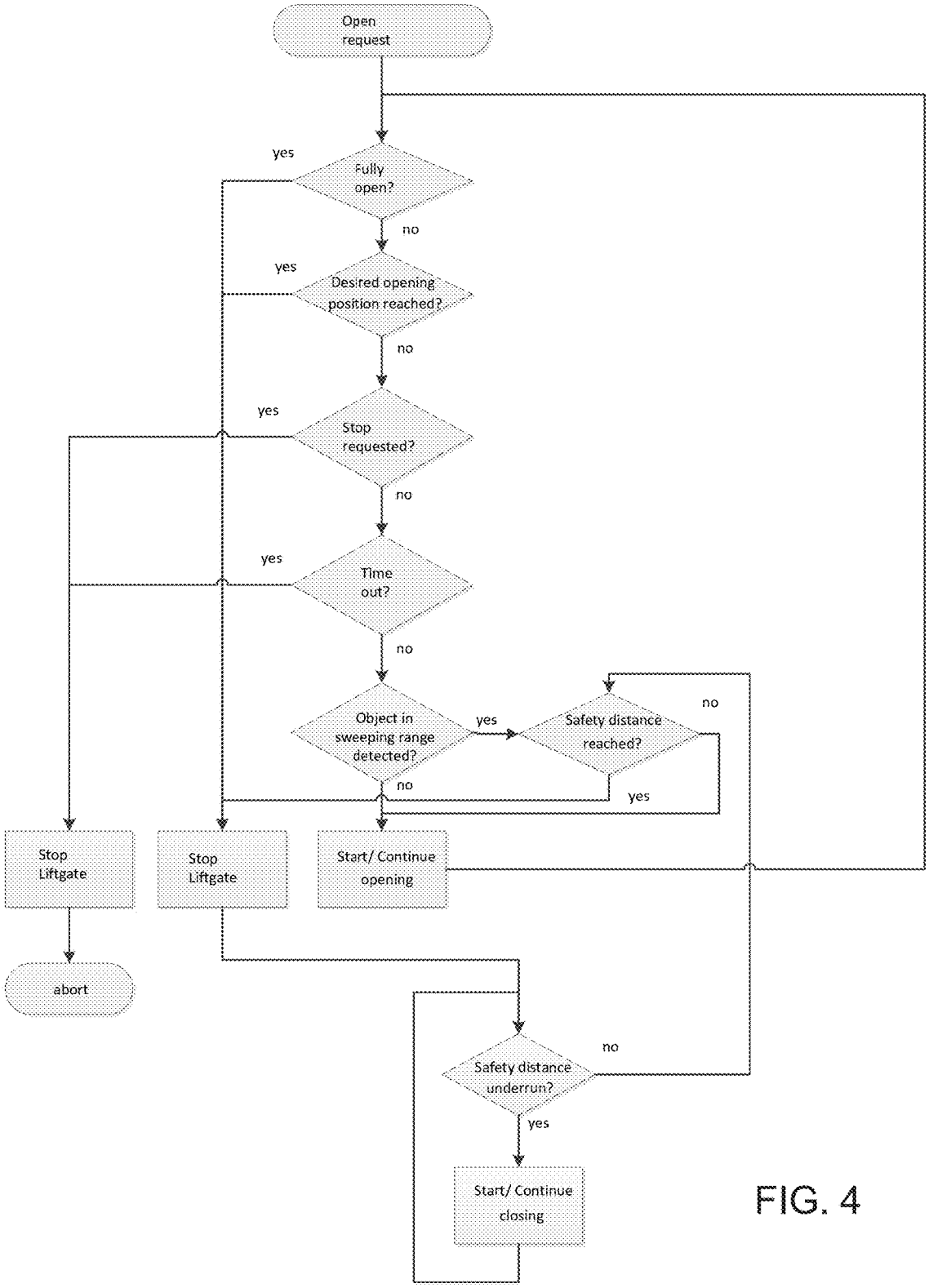

When comparing FIGS. 2A, 2B and 2C with FIGS. 3A and 3B, it becomes obvious that the camera mounting position is important to the outcome so that the opening area of the hatch can be seen or viewed by the camera and by that can be supervised or monitored by the system to limit or substantially preclude the hatch colliding with potential objects (within the range of travel of the hatch). For example, a structure above the car in a parking garage may not be in the field of view of the camera when the hatch (with a generally horizontal pivot axis) is closed and may come into view as the hatch opens, such as when the hatch is (already) half opened (during an opening sweep), such as shown in FIG. 2C. This may be early enough to detect the structure 40 as an object in the sweeping region of the hatch 18. Responsive to such a determination, the system may control a stop of the hatch at a height so that it does not collide with the structure. An exemplary statemachine or flow chart or operation process of such a system is drawn in FIG. 4. The system may use a safety remaining distance control to stop the hatch at a distance (such as indicated with "distance" in FIGS. 13 and 14) before contact with the detected object, and the stopping point (where the system generates a signal to stop the hatch) may have a safety remaining gap or distance or travel (between the hatch and the object) that reflects or accounts for the potential stopping reaction and additional travel of the hatch after the signal is generated (such as due to reaction times of the system and the mass inertia swinging of the hatch and/or the like). An additional cause for height change reflected in the safety remaining gap or distance may be that the vehicle suspension springs may lift (such as indicated with "Lift" in FIG. 14) the vehicle some centimeters (such as, for example, about 15 cm or thereabouts) or the vehicle may roll or pitch when a heavy load is unloaded from the trunk or rear cargo area or when one or more persons exit the vehicle. That safety distance may be a (eventually opening dependent and or voltage dependent, or hatch propulsion motor speed dependent) parameter set for the particular power liftgate, hatch, door or lid application.

Figure 5:
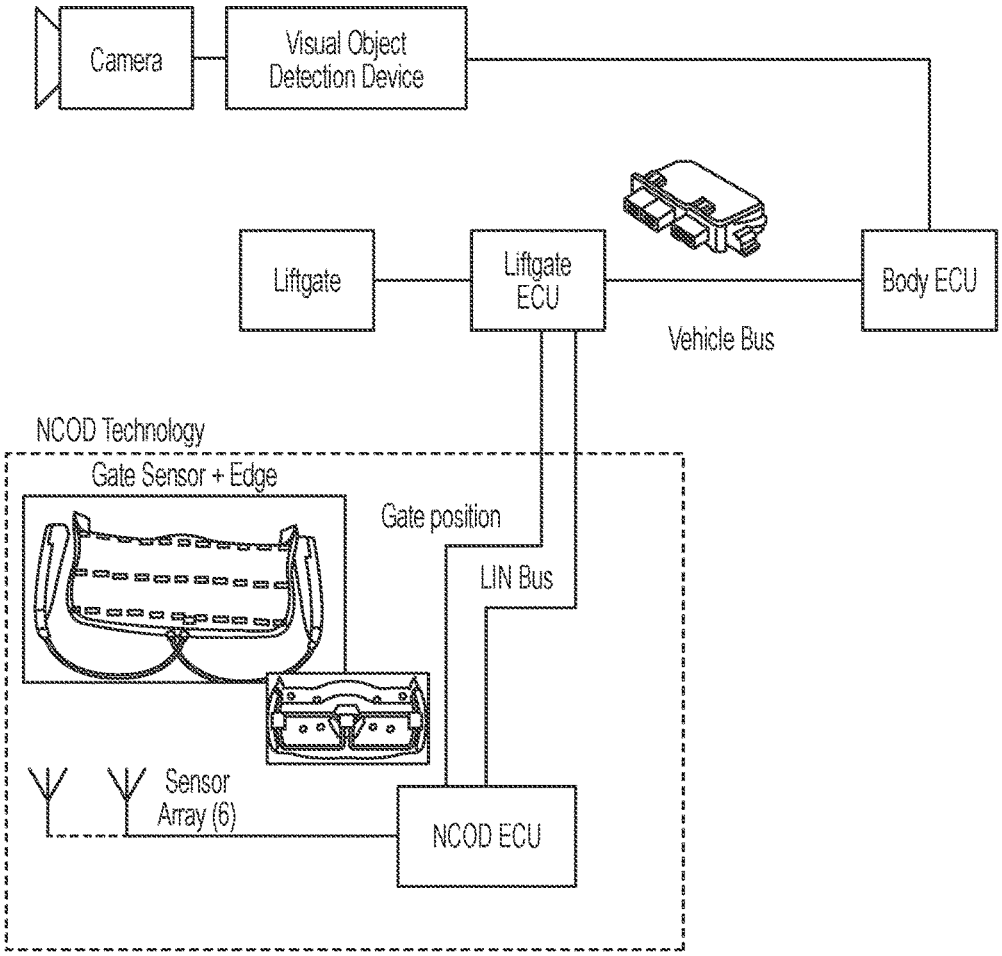
FIG. 5 is a schematic of the liftgate system having a non-contact object detection (NCOD) ECU for avoiding object collision at the inside of the hatch, where a 'Visual Object Detection Device' or system of the vehicle may be connected to or in communication with the NCOD ECU and the power liftgate's system Liftgate ECU via the vehicle's Body ECU in accordance with the present invention.
Figure 6:
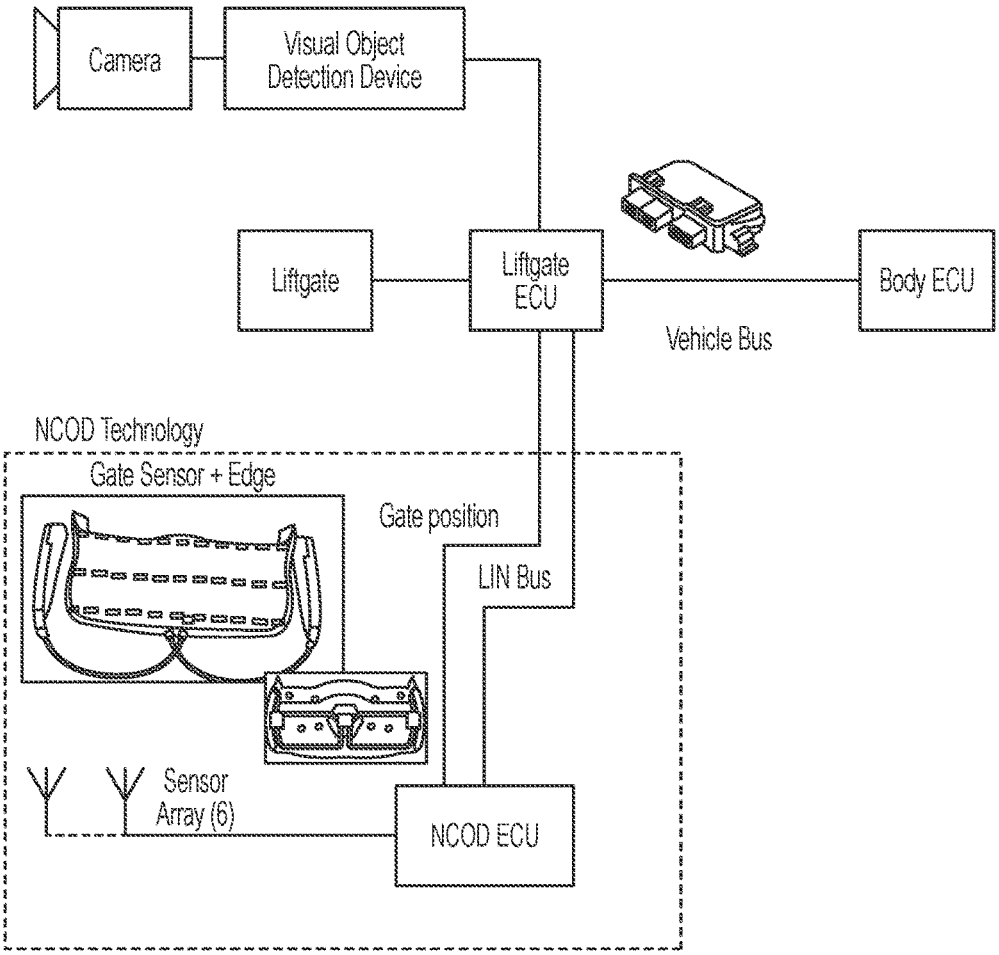
FIG. 6 is a schematic of the liftgate system having a non-contact object detection (NCOD) ECU for avoiding object collision at the inside of the hatch, where a 'Visual Object Detection Device' or system of the vehicle may be connected to or in communication with the NCOD ECU via the power liftgate's system Liftgate ECU in accordance with the present invention.
Figure 7:
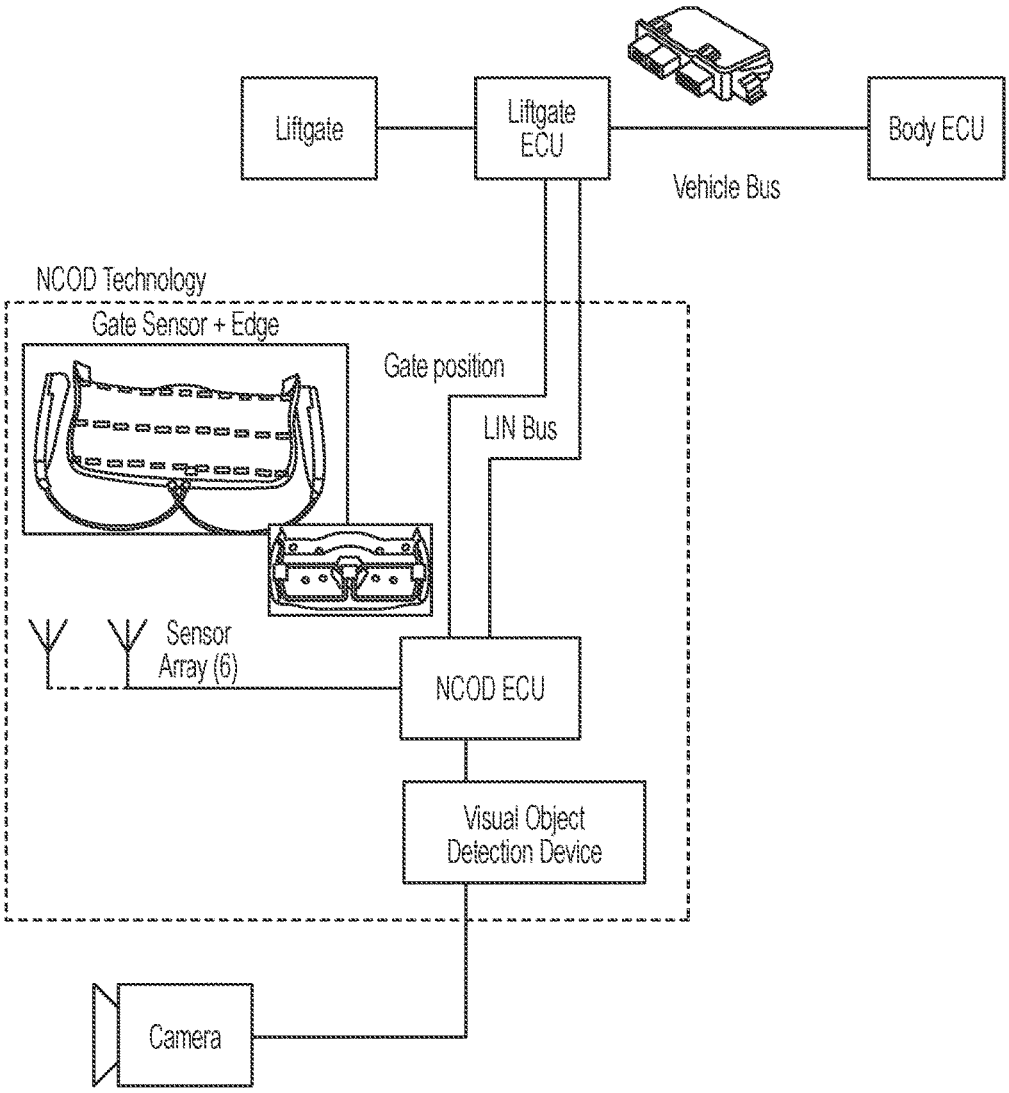
FIG. 7 is a schematic of the liftgate system having a non-contact object detection (NCOD) ECU for avoiding object collision at the inside of the hatch, where a 'Visual Object Detection Device' or system may be connected to or integrated in the NCOD ECU in accordance with the present invention.
Figure 8:
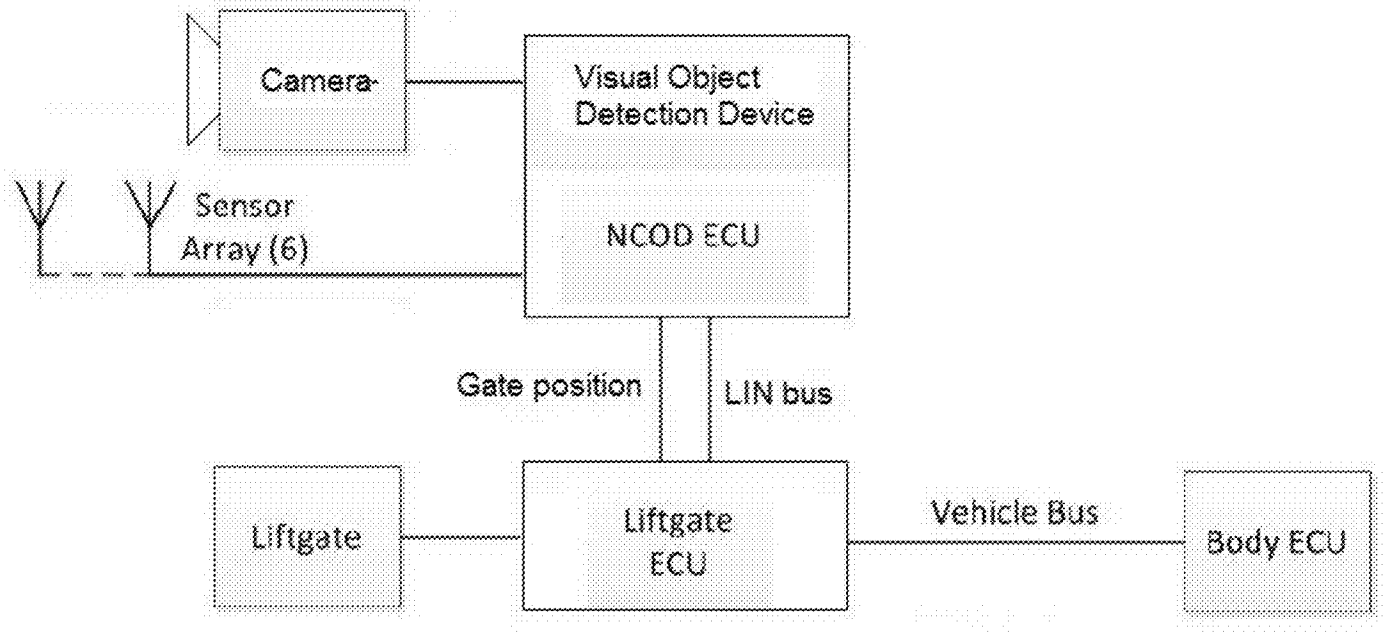
FIG. 8 is a schematic of the liftgate system having a non-contact object detection (NCOD) ECU combined with or integrated in the 'Visual Object Detection Device' or system and connected to the Liftgate ECU in accordance with the present invention.
Figure 9:
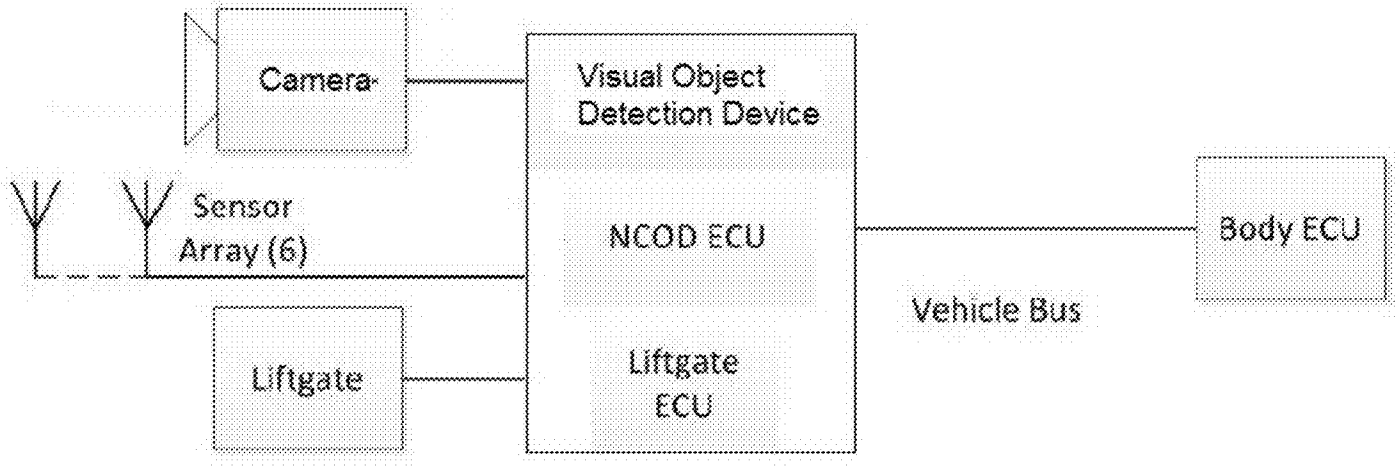
FIG. 9 is a schematic of the liftgate system having a non-contact object detection ECU combined with the 'Visual Object Detection Device' or system and the Liftgate ECU and all incorporated in one singe ECU device in accordance with the present invention.

Optionally, as an advanced option, the liftgate, hatch, door or deck lid may be controlled dynamically by the system of the present invention when the hatch or door or deck lid or liftgate is already stopped at an opening position such as shown in the scene of FIG. 14 (such as at a selected partially opened position or fully opened position). This may be also comprised by the statemachine shown in FIG. 4. When for any reason the vehicle changes in heights (such as, for example, when loading or unloading of the vehicle) or rolls or pitches, the lid may be controlled in the closing or opening direction, propelled or controlled by the liftgate power actuators, to essentially keep or maintain the distance between the hatch and a detected hazardous preferably stationary object. For this option and in general, the visual object detection system may interact with anti-pinch (anti squeeze) sensors and/or control systems, such as shown in the block diagram of FIG. 5 (interacting via the body ECU), FIG. 6 (interacting via the liftgate ECU) and FIG. 7 (attached to a Non-Contact Object Detection (NCOD) ECU), or may be comprised in or attached to a common control device such as like a Non-Contact Object Detection ECU shown in FIGS. 8 and 9. Optionally, there may be busses or wires for controlling the vehicle tail lights. Optional hatch opening switches may be connected to directly by wire or plug or may be incorporated into the camera assembly, such as camera assemblies of the types described in U.S. patent application Ser. No. 14/102,980, filed Dec. 11, 2013 and published Jun. 19, 2014 as U.S. Publication No. US-2014-0168437, which is hereby incorporated herein by reference in its entirety. Optionally, when the hatch is closing, the anti-pinch system may have predominance or priority, because cameras mounted at the outside of the hatch typically cannot be used to supervise the inside sweeping space of the lid or hatch. Additional sensors of the anti-pinch system may include capacitive proximity sensors (mounted at the edge of the lid or opposing car body lid frame), contact rods or Hall sensors for supervising the hatch actuator speed. The actuators may comprise any suitable actuators, such as brush motor spindle drives or worm gear drive brush motors with a gear on the hatch bracket or a con-rod or the like.

Optionally, as another aspect of the invention, the vehicle hatch, liftgate door or trunk lid collision avoidance system may also work when not being adjusted by the power actuators, and when the hatch, door or lid is being opened/closed manually by a user of the vehicle. The system may still detect objects in the path of travel of the power hatch. The actuators may be dynamically controlled (such as via counter actuation or braking) against the manual adjustment direction to actively avoid a threatened contact or collision with an object. Optionally, the system may first act comparably vigorously or aggressively to bring the adjustment to a stop, but then may then substantially reduce the resistance to allow the user/driver to draw the hatch closer to the object when the user still pushes the lid or door or hatch towards the object and overcomes the initial aggressive counter actuation.

In automotive driver assistance systems, object detection (OD) systems and algorithms may be used, such as described in International Publication Nos. WO 2013/081984 and/or WO 2013/081985, and/or U.S. provisional application, Ser. No. 61/919,129, filed Dec. 20, 2013, which are hereby incorporated herein by reference in their entireties. These are mainly based on back projection and/or structure from motion using mono (rear) cameras. Optionally, a distance estimation or determination may be provided via one or more vehicle sensors, such as via stereovision sensors, motion parallax/structure from motion (motion disparity) by mono cameras, a LIDAR sensor, a RADAR sensor, a time of flight (TOF) sensor, a photonic mixer device (PMD), and/or a structured light sensor (a work principle is shown in FIG. 3C), such as by utilizing aspects of the systems described in PCT Application No. PCT/US2013/022119, filed Jan. 18, 2013 and published Jul. 25, 2013 as PCT Publication No. WO 2013/109869, which is hereby incorporated herein by reference in its entirety, and/or the like. For example, use of object detection and object tracking for collision avoidance with vehicle flaps is described in German Publication No. DE102011010242, which is hereby incorporated herein by reference in its entirety.

Optionally, a distance estimation or determination of objects and the environmental scene may be provided by scene image classification, such as from a mono cam, a mono fisheye cam or from a virtually generated superpositioned other view such as a top view image which may be stitched from more than one camera, such as by utilizing aspects of the systems described in U.S. provisional application Ser. No. 61/864,838, filed Aug. 12, 2013, which is hereby incorporated herein by reference in its entirety. The classification algorithm may be additionally capable to classify and by that distinguish humans and body parts from the environment. Optionally, the classification algorithm may be capable to classify or recognize gestures. Optionally, a gesture recognition system may be capable for improving the recognition rate of the gestures by processing the user's behavior feedback, such as utilizing aspects described in U.S. provisional application Ser. No. 61/844,173, filed Jul. 9, 2013, which is hereby incorporated herein by reference in its entirety. Optionally, there may be a gesture for starting the hatch opening (such as, for example, the user raising his or her arm), stopping the hatch opening (such as, for example, showing the hands inner side towards the camera without moving), opening the hatch automatically as wide as possible (if there are no height or width limitations or other hazardous objects within the sweeping space, and such as by, for example, pointing the index finger to the top), opening the hatch to a certain heights as specified by the gesture (for example, the user may hold his or her hand to a certain desired height to limit the system to opening the hatch to that height). Optionally, the system may pick up audio control commands spoken or shouted by the user as alternative or additional command interfaces, such as via an audio input or microphone or the like. This interface may also find use as a supporting interface for driver identification and access authorization or code input, such as discussed below.

Optionally, such a classification algorithm may be part or used in combination of a keyless entry/go access admission system with visual driver identification such as by utilizing aspects of the systems described in U.S. provisional application Ser. No. 61/845,061, filed Jul. 11, 2013, which is hereby incorporated herein by reference in its entirety. In such an application, the classifier may pick up or detect or determine or identify the driver such as when approaching the vehicle. By using learning data sets containing classifications of a human carrying luggage of several kinds and some without luggage, the system may be capable to acknowledge or recognize or identify a person when that person is holding luggage in his or her hands and is standing behind or approaching the vehicle (and the system may automatically open the deck lid or door or hatch when it is determined that the identified person with hands full is the driver or user of the vehicle, such as identified by a passive entry system or the like). Optionally, the system may identify the driver visually (such as via image processing of captured image data) when he or she is partly covered or hidden by the carried item or items. Optionally, the driver may identify himself or herself by the signal of his or her key fob. The system may comprise aspects of or may be incorporated or combined with a vehicle park surveillance system for preventing and video recording vandalism, hit and run and break-ins or the like, such as by utilizing aspects of the systems described in U.S. provisional application Ser. No. 61/760,364, filed Feb. 4, 2013, which is hereby incorporated herein by reference in its entirety. Particularly, and such as described in U.S. provisional application Ser. No. 61/760,364, a system wake up may be found beneficially for further reducing the complexity of the used keyless go system. There may be no need for a key fob, HF and/or LF antenna any more for wake up and security key exchange in cases where the driver identification via camera image classification works sufficiently. Optionally, there may be the possibility for the user/driver to overcome the access system via camera by either sending a text message to the vehicle system, such as via the user's smart phone (optionally using a one time key, provided by an secure instance), entering a master code (optionally via audio interface) or by using a remote key fob having a button to open the car as a fall back solution so as to not lock out the driver/user from his own vehicle when the visible identification fails.

Optionally, the vision system may be connected to or combined with a car-to-car or car-to-infrastructure communication system, which may be capable to provide the view and potential properties of remote parking spaces, especially the widths, lengths and heights. The provided dimensions may be reflected in choosing suitable parking spaces for the vehicle that will allow sufficient space or clearance for opening the doors, hatch or trunk lid of the vehicle, such as by utilizing aspects of the systems described in International Publication No. WO 2013/109869, published Jul. 25, 2013, which is hereby incorporated herein by reference in its entirety.

Powered vehicle hatches, doors, decklids or liftgates or the like are supposed to avoid collision with objects or persons behind or above the vehicle and in the vicinity of the hatch. The present invention provides a vehicle hatch control or aid that detects hazardous objects in the turning area or sweeping path of a vehicle hatch and that is operable to prevent or limit or mitigate collision of the hatch with a detected object present in its path by stopping or reversing movement of the hatch early enough and before impact with an object present in its path. Because many vehicles already include a camera and image processor, such as a rearward facing camera disposed at a rear of a vehicle, the present invention provides a reduced cost system that integrates a hatch collision avoidance aid or control with a camera or image processing function, without additional hardware components (or with only a few additional hardware components) such as ultrasound sensors or such as structured light emitters for enabling the function at low visibility or in darkness. The present invention may also provide a system that operates without reconstructing a proper three dimensional (3D) world reconstruction of the rear of the vehicle.

Optionally, for example, the hatch collision avoidance or control system of the present invention may comprise an array camera (such as utilizing aspects described in U.S. patent application Ser. No. 14/098,817, filed Dec. 6, 2013 and published Jun. 19, 2014 as U.S. Publication No. US-2014-0168415, which is hereby incorporated herein by reference in its entirety), which may be operable to determine distances to objects present in the camera's field of view. The camera may be disposed at the a rear portion of the vehicle and may have a field of view generally rearward of the vehicle so as to encompass the area immediately rearward of the vehicle and in the path of travel of the vehicle hatch as it is opening and/or closing. The single array cameras have disparity to each other by nature (which equates to stereo vision). Typically, distances up to three meters are well detectable by such cameras. This is enough for discriminating potential hazardous objects within the turning area of the hatch.

Optionally, the system may have more than one optic (such as n optics>1 camera (twin, triple, . . . n camera optics)), or the system may have more than one lens (such as m lenses>1 imager (array size X by Y)), or the system may have more than one imager (such as a stereo or multi camera system).

Optionally, the hatch collision avoidance or control system of the present invention may comprise a combination of a time of flight (TOF) light emitter or flash light and a camera or imaging sensor. The camera may capture images of the environment's features and objects present in the field of view of the camera as like usual cameras, and when used as a TOF image sensor (with time of flight shutter) system with time of flight processing may provide a distance estimation from the vehicle to objects present in its field of view. The TOF system may be set up in visual wave lengths or as near infrared system. Such a TOF light emitter, in combination with a camera, can provide a distance estimation or determination that provides enhanced accuracy over some image-based sensing systems.

Optionally, the hatch collision avoidance or control system of the present invention may comprise a HDR (High Dynamic Range) camera that is operable to emphasize the image's features or structures in a wide range of lighting conditions, including bright light conditions, such as daytime lighting conditions, and low lighting conditions, such as nighttime lighting conditions. As an optional addition, combination or alternative, the system may have enhanced low light/night vision capabilities, such as by having effective noise suppression such as stochastically noise reduction and fix pattern noise reduction, such as by utilizing aspects of the systems described in U.S. provisional application Ser. No. 61/919,138, filed Dec. 20, 2013, which is hereby incorporated herein by reference in its entirety, and/or the system may have low light brightness capabilities, such as like a control for frame rate reduction, such as by utilizing aspects of the systems described in U.S. provisional application Ser. No. 61/830,375, filed Jun. 3, 2013, which is hereby incorporated herein by reference in its entirety. Such a camera system may be operable to detect the rear hatch and objects present at the rear of the vehicle without an additional illumination source or the like disposed at the rear of the vehicle. For example, the light emitted from the license plate illumination may be enough to illuminate the area or region immediately rearward of the vehicle to enable the HDR camera with low light enhancement algorithm to capture images that can be used to determine the environment's features or structure.

Optionally, an object detection and distance determining algorithm for evaluating whether or not an object present rearward of the vehicle is within the (known) curved path or way of the hatch may utilize light beams or patterns emitted from the regular tail lights of the vehicle, such as blinkers, license plate illumination, brake lights and position lights or the like. The cover glasses of such a light or such lights may be formed in a manner to emit a structured light pattern (staying, reflecting, bending or focusing), such as like shown in a night scene in FIG. 3C. It may be done in a way that it is still conforms to all other specifications and/or regulations for the specific lights. For example, the vehicle blinker may emit a kind of stripe pattern rearward of the vehicle.

Optionally, the tail lights, especially when these comprise the likes of LED, OLED or Laser diodes or the like, may be temporary controlled by the hatch collision prevention system in low ambient light situations. LEDs typically have the capability to withstand high short time overloads such as of a factor of 10. The hatch collision prevention system control may control the hatch rear lights in a short duration overload such as like a flash. This flash may serve to be used in the optional structured light detection, the optional time of flight detection or in low ambient light conditions to provide more light when it is too dark for the optional camera with or without low light capabilities. The camera's shutter or capturing may be controlled in synchronization to the tail light LED flash, so that image data are captured during the time of illumination by the flashed vehicle light. Optionally, the lights may be near infrared or its light may have a substantial infrared component while the image sensors in the camera may have a substantial infrared sensibility.

Optionally, an image processor of the hatch collision avoidance or control system may utilize an edge and/or point detection algorithm and/or a feature- (blob-) and/or object dedication and distance determining algorithm for evaluating whether or not an object present rearward of the vehicle is within the (known) curved path or way of the hatch. Such a distance detection algorithm may use motion disparity caused by the hatch's own movement (limited to vertical). The system may assume that the vehicle is not in motion itself (parked) when the hatch is being opened and/or closed. Optionally, there may be a subfunctionality of stopping the hatch when the vehicle starts moving.

Optionally, the system may include a hatch actuation state-machine. The state-machine may control a logic to prevent the hatch from opening or to stop the (already running) opening when an object is within the hazardous sweeping space, but may hold the opening request and resume opening when the potential hazardous objects within the sweeping space have moved or been removed out of the path of travel of the vehicle hatch or door. The follow state may be to continue opening. The statemachine in the example of FIG. 4 may act that way. Optionally, the system may provide a warning sound at that time (upon starting to move or resuming movement of the door or hatch) or may run at least in the beginning in a slow moving mode (for a certain time and/or distance). As an exemplary use case, there may be a person in a wheel chair pushing the opening switch at the hatch for opening, and the system may detect the person and the wheel chair as an object within the sweeping space of the hatch. The state-machine may put the hatch actuation system on hold as long as the person in the wheel chair needs for backing up to provide space for the vehicle hatch to open. After that (when the system determines that the wheel chair and person have moved sufficiently from the rear of the vehicle) the system may resume opening of the hatch if no other objects appear in the sweeping space (and if other objects are detected, then the system will again stop or reverse the hatch).

Figure 10:
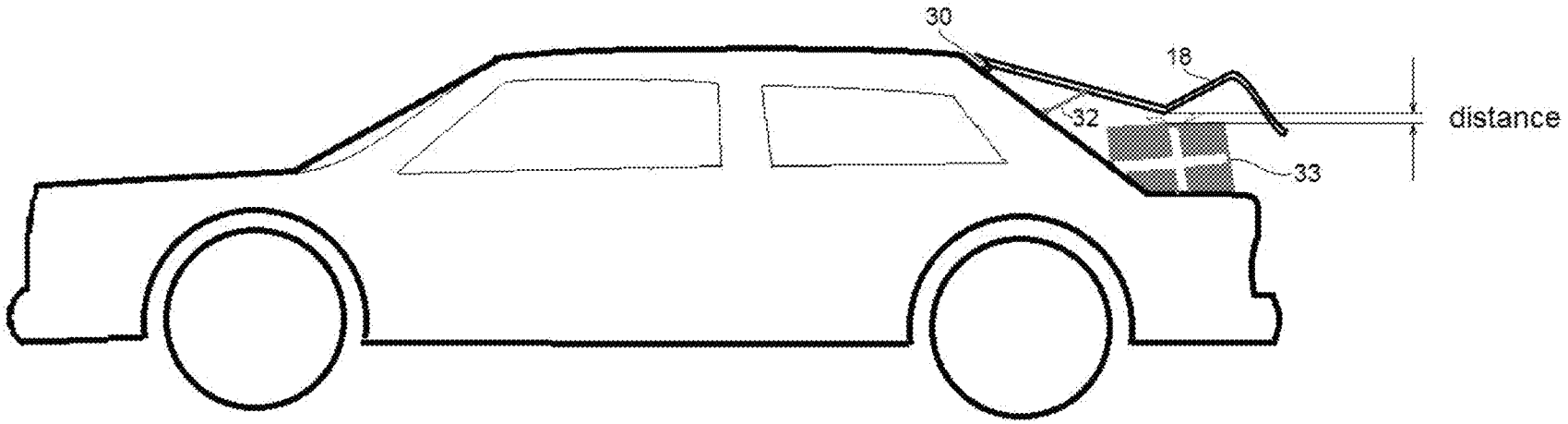
FIG. 10 is a side view of a vehicle, where the hatch actuator control of the present invention may be controlled in a manner to hold the hatch at a partially opened position preset by the user (closing by hand), shown with the opening being just close enough that the luggage can't drop out the trunk, but giving clearance to the luggage so that the luggage is not being squeezed or compressed by the trunk lid.

Optionally, the actuated hatch control logic may possess a kind of freeze mode. The hatch and its actuators may by controlled in a way that it stays in a position the user put it to such as shown in example of FIG. 10. Whatever forces apply, such as by a wind gust when parked or by the wind train behind the vehicle when it is driven or by inertia forces when the vehicle drives over a bump, accelerates or brakes, the system may actuate the actuator against such forces to cope with the forces and/or positional displacements. Optionally, there may be a loop control with the desired lift gate position (formerly adjusted by hand by the user) as an input and the lift gate position as a subtracted feedback input. The control type may be PID with maybe low integrational parameters (for making the system less nervous) or maybe substantial differential parameters (for breaking loose). Optionally, a compensation of the gravity forces to the flap or lift gate may be provided, either by actuator control, which may be an additional (base load) of actuation current to the position dependent actuation current discussed above (where effectively both controls may be implemented in combination), or by any kind of mechanics, such as like a spring or closed air piston within the spindle drives or attached. That function may be useful at times such as when a user puts an item into the trunk that is too large to allow for full closing of the lid or hatch. In such a situation, the user may not want the item to be squeezed and also will not want the hatch or lid to swing up and down while driving (and repeatedly striking the item and scratching the lid's inside). The user also may want the lid to stay closed for not losing the item when driving over a bump or the like. The freezing or retaining of the lid in its partially closed position may be done by a special control command, such as via a car key or remote key or via a trunk lid switch, or by voice or gesture. A trunk lid switch command may be to pull the switch (another time) when the trunk is already partially opened, preferably by hand, not by the actuators. Optionally, the freeze function may be actuated without a special command at times when the user puts the hatch into a certain position by hand and lets it go there or the user may put the hatch into a certain position by hand and may hold a hatch switch or the like, so that when the user lets the hatch go at that position, the hatch opening/closing system holds or freezes or retains the hatch or lid at that selected or desired position.

Thus, the present invention provides a vision system that, utilizing a rear camera (such as a rear camera of a vehicle vision system or driver assistance system or the like) provides a feature detection algorithm (that may utilize disparity mapping or the like, such as by utilizing aspects of the cameras and systems described in International Publication Nos. WO 2013/081984 and/or WO 2013/081985, which are hereby incorporated herein by reference in their entireties) or a combination of various detection algorithms and the like. Such feature detection may be used for discrimination of objects (such as learned or critical or potentially hazardous objects or the like) rearward of the vehicle. The known (learned) critical areas with the according environmental features may be stored in a local or remote database. Such data storage may be done in combination to stored hatch opening limits stored by the user in previous uses of the hatch at specific locations (such as, for example, the users home parking garage, the users work place parking garage, a general/specific parking location or space, and/or the local airport's parking garage and/or the like). Optionally, the system of the present invention may include helping targets, markers or patterns that may be used to support or enhance the system's detection rate of the hatch or the like (for example, stripes of diagonal black and yellow bars may be used at the hatch, such as they are often used for highlighting the maximum headroom at pathways and the like). Optionally, one or more light sources at the vehicle's rear (such as a rear backup light or a brake light or a license plate light or the like) may be engaged or actuated (such as responsive to actuation of the powered hatch opening/closing system) to illuminate the scene at the rear of the vehicle to enhance detection of objects present rearward of the vehicle and potentially in the path of travel of the opening or closing hatch or liftgate.

The vehicle hatch collision avoidance or control system of the present invention thus includes an image processor that processes image data captured by the rear camera to determine if an object is present in the region that is swept by the hatch or liftgate to determine if the hatch may collide with the detected object when it is being opened and/or closed. Responsive to determination of a potential collision of the hatch with a detected object, the system may stop or reverse the movement of the hatch and/or may generate an audible or visual alert to alert the user that a collision or impact is imminent. The vehicle hatch control system may process captured image data to detect objects in the path of travel of the vehicle hatch or liftgate in response to actuation of the powered hatch opening/closing system (such as when a user actuates the hatch opening/closing system via a key fob or via a switch or button in the vehicle or via an external switch or button or sensor at the rear of the vehicle or the like). Optionally, responsive to such actuation of the powered hatch or liftgate opening/closing system, the hatch control system may actuate an illumination source at the rear of the vehicle to illuminate the region at the rear of the vehicle to enhance detection of objects present at the rear of the vehicle. Such activation of an illumination source (such as a rear backup light of the vehicle or a brake light of the vehicle or a license plate light of the vehicle or the like) may also be responsive to a determination of an ambient lighting condition being below a threshold level (with the ambient lighting condition being determined via any suitable means, such as via image processing of image data captured by the rear camera or any other camera or image sensor or photosensor of the vehicle.

The system includes an image processor operable to process image data captured by the camera or cameras, such as for detecting objects or other vehicles or pedestrians or the like in the field of view of one or more of the cameras. For example, the image processor may comprise an EyeQ2 or EyeQ3 image processing chip available from Mobileye Vision Technologies Ltd. of Jerusalem, Israel, and may include object detection software (such as the types described in U.S. Pat. Nos. 7,855,755; 7,720,580 and/or 7,038,577, which are hereby incorporated herein by reference in their entireties), and may analyze image data to detect vehicles and/or other objects. Responsive to such image processing, and when an object or other vehicle is detected, the system may generate an alert to the driver of the vehicle and/or may generate an overlay at the displayed image to highlight or enhance display of the detected object or vehicle, in order to enhance the driver's awareness of the detected object or vehicle or hazardous condition during a driving maneuver of the equipped vehicle.

The camera or imager or imaging sensor may comprise any suitable camera or imager or sensor. Optionally, the camera may comprise a "smart camera" that includes the imaging sensor array and associated circuitry and image processing circuitry and electrical connectors and the like as part of a camera module, such as by utilizing aspects of the vision systems described in International Publication Nos. WO 2013/081984 and/or WO 2013/081985, which is hereby incorporated herein by reference in its entirety.

The vehicle may include any type of sensor or sensors, such as imaging sensors or radar sensors or lidar sensors or ladar sensors or ultrasonic sensors or the like. The imaging sensor or camera may capture image data for image processing and may comprise any suitable camera or sensing device, such as, for example, an array of a plurality of photosensor elements arranged in at least 640 columns and 480 rows (preferably a megapixel imaging array or the like), with a respective lens focusing images onto respective portions of the array. The photosensor array may comprise a plurality of photosensor elements arranged in a photosensor array having rows and columns. The logic and control circuit of the imaging sensor may function in any known manner, and the image processing and algorithmic processing may comprise any suitable means for processing the images and/or image data.

For example, the vision system and/or processing and/or camera and/or circuitry may utilize aspects described in U.S. Pat. Nos. 7,005,974; 5,760,962; 5,877,897; 5,796,094; 5,949,331; 6,222,447; 6,302,545; 6,396,397; 6,498,620; 6,523,964; 6,611,202; 6,201,642; 6,690,268; 6,717,610; 6,757,109; 6,802,617; 6,806,452; 6,822,563; 6,891,563; 6,946,978; 7,859,565; 5,550,677; 5,670,935; 6,636,258; 7,145,519; 7,161,616; 7,230,640; 7,248,283; 7,295,229; 7,301,466; 7,592,928; 7,881,496; 7,720,580; 7,038,577; 6,882,287; 5,929,786 and/or 5,786,772, and/or International Publication Nos. WO 2011/028686; WO 2010/099416; WO 2012/061567; WO 2012/068331; WO 2012/075250; WO 2012/103193; WO 2012/0116043; WO 2012/0145313; WO 2012/0145501; WO 2012/145818; WO 2012/145822; WO 2012/158167; WO 2012/075250; WO 2012/0116043; WO 2012/0145501; WO 2012/154919; WO 2013/019707; WO 2013/016409; WO 2013/019795; WO 2013/067083; WO 2013/070539; WO 2013/043661; WO 2013/048994; WO 2013/063014, WO 2013/081984; WO 2013/081985; WO 2013/074604; WO 2013/086249; WO 2013/103548; WO 2013/109869; WO 2013/123161; WO 2013/126715; WO 2013/043661 and/or WO 2013/158592 and/or U.S. patent application Ser. No. 14/107,624, filed Dec. 16, 2013, now U.S. Pat. No. 9,140,789; Ser. No. 14/102,981, filed Dec. 11, 2013 and published Jun. 12, 2014 as U.S. Publication No. US-2014-0160276; Ser. No. 14/102,980, filed Dec. 11, 2013 and published Jun. 19, 2014 as U.S. Publication No. US-2014-0168437; Ser. No. 14/098,817, filed Dec. 6, 2013 and published Jun. 19, 2014 as U.S. Publication No. US-2014-0168415; Ser. No. 14/097,581, filed Dec. 5, 2013 and published Jun. 12, 2014 as U.S. Publication No. US-2014-0160291; Ser. No. 14/093,981, filed Dec. 2, 2013, now U.S. Pat. No. 8,917,169; Ser. No. 14/093,980, filed Dec. 2, 2013 and published Jun. 5, 2014 as U.S. Publication No. US-2014-0152825; Ser. No. 14/082,573, filed Nov. 18, 2013 and published May 22, 2014 as U.S. Publication No. US-2014-0139676; Ser. No. 14/082,574, filed Nov. 18, 2013, now U.S. Pat. No. 9,307,640; Ser. No. 14/082,575, filed Nov. 18, 2013, now U.S. Pat. No. 9,090,234; Ser. No. 14/082,577, filed Nov. 18, 2013, now U.S. Pat. No. 8,818,042; Ser. No. 14/071,086, filed Nov. 4, 2013, now U.S. Pat. No. 8,886,401; Ser. No. 14/076,524, filed Nov. 11, 2013, now U.S. Pat. No. 9,077,962; Ser. No. 14/052,945, filed Oct. 14, 2013 and published Apr. 17, 2014 as U.S. Publication No. US-2014-0104426; Ser. No. 14/046,174, filed Oct. 4, 2013 and published Apr. 10, 2014 as U.S. Publication No. US-2014-0098229; Ser. No. 14/016,790, filed Oct. 3, 2013 and published Mar. 6, 2014 as U.S. Publication No. US-2014-0067206; Ser. No. 14/036,723, filed Sep. 25, 2013 and published Mar. 27, 2014 as U.S. Publication No. US-2014-0085472; Ser. No. 14/016,790, filed Sep. 3, 2013 and published Mar. 6, 2014 as U.S. Publication No. US-2014-0067206; Ser. No. 14/001,272, filed Aug. 23, 2013, now U.S. Pat. No. 9,233,641; Ser. No. 13/970,868, filed Aug. 20, 2013 and published Feb. 20, 2014 as U.S. Publication No. US-2014-0049646; Ser. No. 13/964,134, filed Aug. 12, 2013 and published Feb. 20, 2014 as U.S. Publication No. US-2014-0052340; Ser. No. 13/942,758, filed Jul. 16, 2013 and published Jan. 23, 2014 as U.S. Publication No. US-2014-0025240; Ser. No. 13/942,753, filed Jul. 16, 2013 and published Jan. 30, 2014 as U.S. Publication No. US-2014-0028852; Ser. No. 13/927,680, filed Jun. 26, 2013 and published Jan. 2, 2014 as U.S. Publication No. US-2014-0005907; Ser. No. 13/916,051, filed Jun. 12, 2013, now U.S. Pat. No. 9,077,098; Ser. No. 13/894,870, filed May 15, 2013 and published Nov. 28, 2013 as U.S. Publication No. US-2013-0314503; Ser. No. 13/887,724, filed May 6, 2013 and published Nov. 14, 2013 as U.S. Publication No. US-2013-0298866; Ser. No. 13/852,190, filed Mar. 28, 2013 and published Aug. 29, 2013 as U.S. Publication No. US-2013-0222593; Ser. No. 13/851,378, filed Mar. 27, 2013, now U.S. Pat. No. 9,319,637; Ser. No. 13/848,796, filed Mar. 22, 2012 and published Oct. 24, 2013 as U.S. Publication No. US-2013-0278769; Ser. No. 13/847,815, filed Mar. 20, 2013 and published Oct. 31, 2013 as U.S. Publication No. US-2013-0286193; Ser. No. 13/800,697, filed Mar. 13, 2013 and published Oct. 3, 2013 as U.S. Publication No. US-2013-0258077; Ser. No. 13/785,099, filed Mar. 5, 2013 and published Sep. 19, 2013 as U.S. Publication No. US-2013-0242099; Ser. No. 13/779,881, filed Feb. 28, 2013, now U.S. Pat. No. 8,694,224; Ser. No. 13/774,317, filed Feb. 22, 2013 and published Aug. 29, 2013 as U.S. Publication No. US-2013-0222592; Ser. No. 13/774,315, filed Feb. 22, 2013 and published Aug. 22, 2013 as U.S. Publication No. US-2013-0215271; Ser. No. 13/681,963, filed Nov. 20, 2012, now U.S. Pat. No. 9,264,673; Ser. No. 13/660,306, filed Oct. 25, 2012, now U.S. Pat. No. 9,146,898; Ser. No. 13/653,577, filed Oct. 17, 2012, now U.S. Pat. No. 9,174,574; and/or Ser. No. 13/534,657, filed Jun. 27, 2012 and published Jan. 3, 2013 as U.S. Publication No. US-2013-0002873, and/or U.S. provisional applications, Ser. No. 61/919,129, filed Dec. 20, 2013; Ser. No. 61/919,130, filed Dec. 20, 2013; Ser. No. 61/919,131, filed Dec. 20, 2013; Ser. No. 61/919,147, filed Dec. 20, 2013; Ser. No. 61/919,138, filed Dec. 20, 2013, Ser. No. 61/919,133, filed Dec. 20, 2013; Ser. No. 61/918,290, filed Dec. 19, 2013; Ser. No. 61/915,218, filed Dec. 12, 2013; Ser. No. 61/912,146, filed Dec. 5, 2013; Ser. No. 61/911,666, filed Dec. 4, 2013; Ser. No. 61/911,665, filed Dec. 4, 2013; Ser. No. 61/905,461, filed Nov. 18, 2013; Ser. No. 61/905,462, filed Nov. 18, 2013; Ser. No. 61/901,127, filed Nov. 7, 2013; Ser. No. 61/895,610, filed Oct. 25, 2013; Ser. No. 61/895,609, filed Oct. 25, 2013; Ser. No. 61/893,489, filed Oct. 21, 2013; Ser. No. 61/886,883, filed Oct. 4, 2013; Ser. No. 61/879,837, filed Sep. 19, 2013; Ser. No. 61/879,835, filed Sep. 19, 2013; Ser. No. 61/878,877, filed Sep. 17, 2013; Ser. No. 61/875,351, filed Sep. 9, 2013; Ser. No. 61/869,195, filed. Aug. 23, 2013; Ser. No. 61/864,835, filed Aug. 12, 2013; Ser. No. 61/864,836, filed Aug. 12, 2013; Ser. No. 61/864,837, filed Aug. 12, 2013; Ser. No. 61/864,838, filed Aug. 12, 2013; Ser. No. 61/856,843, filed Jul. 22, 2013, Ser. No. 61/845,061, filed Jul. 11, 2013; Ser. No. 61/844,630, filed Jul. 10, 2013; Ser. No. 61/844,173, filed Jul. 9, 2013; Ser. No. 61/844,171, filed Jul. 9, 2013; Ser. No. 61/842,644, filed Jul. 3, 2013; Ser. No. 61/840,542, filed Jun. 28, 2013; Ser. No. 61/838,619, filed Jun. 24, 2013; Ser. No. 61/838,621, filed Jun. 24, 2013; Ser. No. 61/837,955, filed Jun. 21, 2013; Ser. No. 61/836,900, filed Jun. 19, 2013; Ser. No. 61/836,380, filed Jun. 18, 2013; Ser. No. 61/834,129, filed Jun. 12, 2013; Ser. No. 61/833,080, filed Jun. 10, 2013; Ser. No. 61/830,375, filed Jun. 3, 2013; Ser. No. 61/830,377, filed Jun. 3, 2013; Ser. No. 61/825,752, filed May 21, 2013; Ser. No. 61/825,753, filed May 21, 2013; Ser. No. 61/823,648, filed May 15, 2013; Ser. No. 61/823,644, filed May 15, 2013; Ser. No. 61/821,922, filed May 10, 2013; Ser. No. 61/819,835, filed May 6, 2013; Ser. No. 61/819,033, filed May 3, 2013; Ser. No. 61/816,956, filed Apr. 29, 2013; Ser. No. 61/815,044, filed Apr. 23, 2013; Ser. No. 61/814,533, filed Apr. 22, 2013; Ser. No. 61/813,361, filed Apr. 18, 2013; Ser. No. 61/810,407, filed Apr. 10, 2013; Ser. No. 61/808,930, filed Apr. 5, 2013; Ser. No. 61/807,050, filed Apr. 1, 2013; Ser.

No. 61/806,674, filed Mar. 29, 2013; Ser. No. 61/793,592, filed Mar. 15, 2013; Ser. No. 61/772,015, filed Mar. 4, 2013; Ser. No. 61/772,014, filed Mar. 4, 2013; Ser. No. 61/770,051, filed Feb. 27, 2013; Ser. No. 61/766,883, filed Feb. 20, 2013; Ser. No. 61/760,366, filed Feb. 4, 2013; Ser. No. 61/760,364, filed Feb. 4, 2013; and/or Ser. No. 61/756,832, filed Jan. 25, 2013, which are all hereby incorporated herein by reference in their entireties. The system may communicate with other communication systems via any suitable means, such as by utilizing aspects of the systems described in International Publication Nos. WO/2010/144900; WO 2013/043661 and/or WO 2013/081985, and/or U.S. patent application Ser. No. 13/202,005, filed Aug. 17, 2011, now U.S. Pat. No. 9,126,525, which are hereby incorporated herein by reference in their entireties.

The imaging device and control and image processor and any associated illumination source, if applicable, may comprise any suitable components, and may utilize aspects of the cameras and vision systems described in U.S. Pat. Nos. 5,550,677; 5,877,897; 6,498,620; 5,670,935; 5,796,094; 6,396,397; 6,806,452; 6,690,268; 7,005,974; 7,937,667; 7,123,168; 7,004,606; 6,946,978; 7,038,577; 6,353,392; 6,320,176; 6,313,454 and 6,824,281, and/or International Publication Nos. WO 2010/099416; WO 2011/028686 and/or WO 2013/016409, and/or U.S. patent application Ser. No. 12/508,840, filed Jul. 24, 2009, and published Jan. 28, 2010 as U.S. Pat. Publication No. US 2010-0020170, and/or U.S. patent application Ser. No. 13/534,657, filed Jun. 27, 2012 and published Jan. 3, 2013 as U.S. Publication No. US-2013-0002873, which are all hereby incorporated herein by reference in their entireties. The camera or cameras may comprise any suitable cameras or imaging sensors or camera modules, and may utilize aspects of the cameras or sensors described in U.S. patent application Ser. No. 12/091,359, filed Apr. 24, 2008 and published Oct. 1, 2009 as U.S. Publication No. US-2009-0244361, and/or Ser. No. 13/260,400, filed Sep. 26, 2011, now U.S. Pat. No. 8,542,451, and/or U.S. Pat. Nos. 7,965,336 and/or 7,480,149, which are hereby incorporated herein by reference in their entireties. The imaging array sensor may comprise any suitable sensor, and may utilize various imaging sensors or imaging array sensors or cameras or the like, such as a CMOS imaging array sensor, a CCD sensor or other sensors or the like, such as the types described in U.S. Pat. Nos. 5,550,677; 5,670,935; 5,760,962; 5,715,093; 5,877,897; 6,922,292; 6,757,109; 6,717,610; 6,590,719; 6,201,642; 6,498,620; 5,796,094; 6,097,023; 6,320,176; 6,559,435; 6,831,261; 6,806,452; 6,396,397; 6,822,563; 6,946,978; 7,339,149; 7,038,577; 7,004,606; 7,720,580 and/or 7,965,336, and/or International Publication Nos. WO/2009/036176 and/or WO/2009/046268, which are all hereby incorporated herein by reference in their entireties.

The camera module and circuit chip or board and imaging sensor may be implemented and operated in connection with various vehicular vision-based systems, and/or may be operable utilizing the principles of such other vehicular systems, such as a vehicle headlamp control system, such as the type disclosed in U.S. Pat. Nos. 5,796,094; 6,097,023; 6,320,176; 6,559,435; 6,831,261; 7,004,606; 7,339,149 and/or 7,526,103, which are all hereby incorporated herein by reference in their entireties, a rain sensor, such as the types disclosed in commonly assigned U.S. Pat. Nos. 6,353,392; 6,313,454; 6,320,176 and/or 7,480,149, which are hereby incorporated herein by reference in their entireties, a vehicle vision system, such as a forwardly, sidewardly or rearwardly directed vehicle vision system utilizing principles disclosed in U.S. Pat. Nos. 5,550,677; 5,670,935; 5,760,962; 5,877,897; 5,949,331; 6,222,447; 6,302,545; 6,396,397; 6,498,620; 6,523,964; 6,611,202; 6,201,642; 6,690,268; 6,717,610; 6,757,109; 6,802,617; 6,806,452; 6,822,563; 6,891,563; 6,946,978 and/or 7,859,565, which are all hereby incorporated herein by reference in their entireties, a trailer hitching aid or tow check system, such as the type disclosed in U.S. Pat. No. 7,005,974, which is hereby incorporated herein by reference in its entirety, a reverse or sideward imaging system, such as for a lane change assistance system or lane departure warning system or for a blind spot or object detection system, such as imaging or detection systems of the types disclosed in U.S. Pat. Nos. 7,720,580; 7,038,577; 5,929,786 and/or 5,786,772, and/or U.S. patent application Ser. No. 11/239,980, filed Sep. 30, 2005, now U.S. Pat. No. 7,881,496, and/or U.S. provisional applications, Ser. No. 60/628,709, filed Nov. 17, 2004; Ser. No. 60/614,644, filed Sep. 30, 2004; Ser. No. 60/618,686, filed Oct. 14, 2004; Ser. No. 60/638,687, filed Dec. 23, 2004, which are hereby incorporated herein by reference in their entireties, a video device for internal cabin surveillance and/or video telephone function, such as disclosed in U.S. Pat. Nos. 5,760,962; 5,877,897; 6,690,268 and/or 7,370,983, and/or U.S. patent application Ser. No. 10/538,724, filed Jun. 13, 2005 and published Mar. 9, 2006 as U.S. Publication No. US-2006-0050018, which are hereby incorporated herein by reference in their entireties, a traffic sign recognition system, a system for determining a distance to a leading or trailing vehicle or object, such as a system utilizing the principles disclosed in U.S. Pat. Nos. 6,396,397 and/or 7,123,168, which are hereby incorporated herein by reference in their entireties, and/or the like.

Optionally, the circuit board or chip may include circuitry for the imaging array sensor and or other electronic accessories or features, such as by utilizing compass-on-a-chip or EC driver-on-a-chip technology and aspects such as described in U.S. Pat. No. 7,255,451 and/or U.S. Pat. No. 7,480,149; and/or U.S. patent application Ser. No. 11/226,628, filed Sep. 14, 2005 and published Mar. 23, 2006 as U.S. Publication No. US-2006-0061008, and/or Ser. No. 12/578,732, filed Oct. 14, 2009 and published Apr. 22, 2010 as U.S. Publication No. US-2010-0097469, which are hereby incorporated herein by reference in their entireties.

Optionally, the vision system may include a display for displaying images captured by one or more of the imaging sensors for viewing by the driver of the vehicle while the driver is normally operating the vehicle. Optionally, for example, the vision system may include a video display device disposed at or in the interior rearview mirror assembly of the vehicle, such as by utilizing aspects of the video mirror display systems described in U.S. Pat. No. 6,690,268 and/or U.S. patent application Ser. No. 13/333,337, filed Dec. 21, 2011, now U.S. Pat. No. 9,264,672, which are hereby incorporated herein by reference in their entireties. The video mirror display may comprise any suitable devices and systems and optionally may utilize aspects of the compass display systems described in U.S. Pat. Nos. 7,370,983; 7,329,013; 7,308,341; 7,289,037; 7,249,860; 7,004,593; 4,546,551; 5,699,044; 4,953,305; 5,576,687; 5,632,092; 5,677,851; 5,708,410; 5,737,226; 5,802,727; 5,878,370; 6,087,953; 6,173,508; 6,222,460; 6,513,252 and/or 6,642,851, and/or European patent application, published Oct. 11, 2000 under Publication No. EP 0 1043566, and/or U.S. patent application Ser. No. 11/226,628, filed Sep. 14, 2005 and published Mar. 23, 2006 as U.S. Publication No. US-2006-0061008, which are all hereby incorporated herein by reference in their entireties. Optionally, the video mirror display screen or device may be operable to display images captured by a rearward viewing camera of the vehicle during a reversing maneuver of the vehicle (such as responsive to the vehicle gear actuator being placed in a reverse gear position or the like) to assist the driver in backing up the vehicle, and optionally may be operable to display the compass heading or directional heading character or icon when the vehicle is not undertaking a reversing maneuver, such as when the vehicle is being driven in a forward direction along a road (such as by utilizing aspects of the display system described in PCT Application No. PCT/US2011/056295, filed Oct. 14, 2011 and published Apr. 19, 2012 as International Publication No. WO 2012/051500, which is hereby incorporated herein by reference in its entirety).

Optionally, the vision system (utilizing the forward facing camera and a rearward facing camera and other cameras disposed at the vehicle with exterior fields of view) may be part of or may provide a display of a top-down view or birds-eye view system of the vehicle or a surround view at the vehicle, such as by utilizing aspects of the vision systems described in International Publication Nos. WO 2010/099416; WO 2011/028686; WO 2012/075250; WO 2013/019795; WO 2012/075250; WO 2012/145822; WO 2013/081985; WO 2013/086249 and/or WO 2013/109869, and/or U.S. patent application Ser. No. 13/333,337, filed Dec. 21, 2011, now U.S. Pat. No. 9,264,672, which are hereby incorporated herein by reference in their entireties.

Optionally, a video mirror display may be disposed rearward of and behind the reflective element assembly and may comprise a display such as the types disclosed in U.S. Pat. Nos. 5,530,240; 6,329,925; 7,855,755; 7,626,749; 7,581,859; 7,446,650; 7,370,983; 7,338,177; 7,274,501; 7,255,451; 7,195,381; 7,184,190; 5,668,663; 5,724,187 and/or 6,690,268, and/or in U.S. patent application Ser. No. 12/091,525, filed Apr. 25, 2008, now U.S. Pat. No. 7,855,755; Ser. No. 11/226,628, filed Sep. 14, 2005 and published Mar. 23, 2006 as U.S. Publication No. US-2006-0061008; and/or Ser. No. 10/538,724, filed Jun. 13, 2005 and published Mar. 9, 2006 as U.S. Publication No. US-2006-0050018, which are all hereby incorporated herein by reference in their entireties. The display is viewable through the reflective element when the display is activated to display information. The display element may be any type of display element, such as a vacuum fluorescent (VF) display element, a light emitting diode (LED) display element, such as an organic light emitting diode (OLED) or an inorganic light emitting diode, an electroluminescent (EL) display element, a liquid crystal display (LCD) element, a video screen display element or backlit thin film transistor (TFT) display element or the like, and may be operable to display various information (as discrete characters, icons or the like, or in a multi-pixel manner) to the driver of the vehicle, such as passenger side inflatable restraint (PSIR) information, tire pressure status, and/or the like. The mirror assembly and/or display may utilize aspects described in U.S. Pat. Nos. 7,184,190; 7,255,451; 7,446,924 and/or 7,338,177, which are all hereby incorporated herein by reference in their entireties. The thicknesses and materials of the coatings on the substrates of the reflective element may be selected to provide a desired color or tint to the mirror reflective element, such as a blue colored reflector, such as is known in the art and such as described in U.S. Pat. Nos. 5,910,854; 6,420,036 and/or 7,274,501, which are hereby incorporated herein by reference in their entireties.

Optionally, the display or displays and any associated user inputs may be associated with various accessories or systems, such as, for example, a tire pressure monitoring system or a passenger air bag status or a garage door opening system or a telematics system or any other accessory or system of the mirror assembly or of the vehicle or of an accessory module or console of the vehicle, such as an accessory module or console of the types described in U.S. Pat. Nos. 7,289,037; 6,877,888; 6,824,281; 6,690,268; 6,672,744; 6,386,742 and 6,124,886, and/or U.S. patent application Ser. No. 10/538,724, filed Jun. 13, 2005 and published Mar. 9, 2006 as U.S. Publication No. US-2006-0050018, which are hereby incorporated herein by reference in their entireties.

Changes and modifications to the specifically described embodiments may be carried out without departing from the principles of the present invention, which is intended to be limited only by the scope of the appended claims as interpreted according to the principles of patent law.

The invention claimed is:

1. A vehicle door control system, said vehicle door control system comprising:

a camera disposed at a portion of a vehicle equipped with said vehicle door control system, said camera having a field of view that encompasses a region exterior of the equipped vehicle that is swept by a door of the equipped vehicle as the door is opened and closed via a powered door opening/closing system of the equipped vehicle;

an image processor operable to process image data captured by said camera to detect an object present in the region that is swept by the door when the door is opening and to determine if the door may collide with the detected object when the door is being opened;

wherein, during opening of the door and responsive to determination, via image processing by said image processor of image data captured by said camera, of a potential collision of the opening door with the detected object, said vehicle door control system positions the door at a partially open position whereby a gap having a predetermined gap dimension between the door and the detected object is established and maintained between the door and the detected object; and wherein said vehicle door control system, at least via image processing by said image processor of image data captured by said camera, maintains the gap having the predetermined gap dimension between the door and the detected object when movement of the vehicle relative to the detected object occurs.

2. The vehicle door control system of claim 1, wherein, responsive to determination, via said image processing, of the potential collision of the door with the detected object, said vehicle door control system generates at least one of (i) an audible alert and (ii) a visual alert.

3. The vehicle door control system of claim 2, wherein the door comprises one of a liftgate of the equipped vehicle, a deck lid of the equipped vehicle and a rear door of the equipped vehicle.

4. The vehicle door control system of claim 1, wherein said vehicle door control system is operable to stop movement of the door when the door is at a selected distance to the detected object.

5. The vehicle door control system of claim 1, wherein, responsive to actuation of the powered door opening/closing system of the equipped vehicle, said vehicle door control system is operable to actuate an illumination source at the exterior of the equipped vehicle to illuminate exterior of the equipped vehicle to enhance detection of objects present exterior of the equipped vehicle.

6. The vehicle door control system of claim 5, wherein activation of said illumination source is responsive to a determination of an ambient lighting condition being below a threshold level.

7. The vehicle door control system of claim 1, wherein said vehicle door control system is operable to open the door responsive to a gesture recognition system.

8. The vehicle door control system of claim 7, wherein said vehicle door control system is operable to stop movement of the door when the door is at a selected distance to the detected object.

9. The vehicle door control system of claim 1, wherein said vehicle door control system continues movement of the door responsive to a determination that the path of travel of the door is clear.

10. The vehicle door control system of claim 1, wherein determination, via image processing by said image processor of image data captured by said camera, of the potential collision of the opening door with the detected object comprises distance estimation to the detected object.

11. The vehicle door control system of claim 10, wherein distance estimation to the detected object is provided by scene image classification.

12. The vehicle door control system of claim 10, wherein distance estimation to the detected object is provided by time of flight sensing.

13. A vehicle door control system, said vehicle door control system comprising:

a camera disposed at a portion of a vehicle equipped with said vehicle door control system, said camera having a field of view that encompasses a region exterior of the equipped vehicle that is swept by a door of the equipped vehicle as the door is opened and closed via a powered door opening/closing system of the equipped vehicle;

an image processor operable to process image data captured by said camera to detect an object present in the region that is swept by the door when the door is opening and to determine if the door may collide with the detected object when the door is being opened;

wherein said vehicle door control system comprises a distance-estimating sensor that estimates distance to the detected object;

wherein, during opening of the door and responsive to determination, via image processing by said image processor of image data captured by said camera, of a potential collision of the opening door with the detected object, said vehicle door control system, responsive at least in part to said distance-estimating sensor, positions the door at a partially open position whereby a gap having a predetermined gap dimension between the door and the detected object is established and maintained between the door and the detected object; and wherein said vehicle door control system, at least via image processing by said image processor of image data captured by said camera, maintains the gap having the predetermined gap dimension between the door and the detected object when movement of the vehicle relative to the detected object occurs.

14. The vehicle door control system of claim 13, wherein said distance-estimating sensor comprises said camera.

15. The vehicle door control system of claim 13, wherein said distance-estimating sensor comprises a time of flight sensor.

16. The vehicle door control system of claim 13, wherein said distance-estimating sensor comprises a radar sensor.

17. A vehicle door control system, said vehicle door control system comprising:

a camera disposed at a portion of a vehicle equipped with said vehicle door control system, said camera having a field of view that encompasses a region exterior of the equipped vehicle that is swept by a door of the equipped vehicle as the door is opened and closed via a powered door opening/closing system of the equipped vehicle;

an image processor operable to process image data captured by said camera to detect an object present in the region that is swept by the door when the door is opening and to determine if the door may collide with the detected object when the door is being opened;

wherein said vehicle door control system comprises a distance-estimating sensor that estimates distance to the detected object;

wherein, during opening of the door and responsive to determination, via image processing by said image processor of image data captured by said camera, of a potential collision of the opening door with the detected object, said vehicle door control system, responsive at least in part to said distance-estimating sensor, positions the door at a partially open position whereby a gap having a predetermined gap dimension between the door and the detected object is established and maintained between the door and the detected object;

wherein said vehicle door control system is operable to stop movement of the door when the door is at a selected distance to the detected object so as to establish and maintain the gap between the door and the detected object; and wherein said vehicle door control system, at least via image processing by said image processor of image data captured by said camera, maintains the gap having the predetermined gap dimension between the door and the detected object when movement of the vehicle relative to the detected object occurs.

18. The vehicle door control system of claim 17, wherein the door comprises a rear door of the equipped vehicle.

19. The vehicle door control system of claim 17, wherein the door comprises a liftgate of the equipped vehicle.

20. The vehicle door control system of claim 19, wherein said vehicle door control system is operable to open said liftgate responsive to a gesture recognition system.

21. The vehicle door control system of claim 17, wherein said vehicle door control system continues movement of the door responsive to a determination that the path of travel of the door is clear.

* * * * *